US010071790B2

(12) United States Patent
Roodenburg et al.

(10) Patent No.: US 10,071,790 B2
(45) Date of Patent: Sep. 11, 2018

(54) SUBSEA WELLBORE OPERATIONS VESSEL

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/517,841

(22) PCT Filed: Oct. 9, 2015

(86) PCT No.: PCT/EP2015/073410
§ 371 (c)(1),
(2) Date: Apr. 7, 2017

(87) PCT Pub. No.: WO2016/055616
PCT Pub. Date: Apr. 14, 2016

(65) Prior Publication Data

US 2017/0305510 A1 Oct. 26, 2017

(30) Foreign Application Priority Data

Oct. 10, 2014 (NL) ..... 2013614

(51) Int. Cl.
*E21B 19/00* (2006.01)
*E21B 19/15* (2006.01)
(Continued)

(52) U.S. Cl.
CPC ..... *B63B 35/4413* (2013.01); *E21B 19/004* (2013.01); *E21B 19/155* (2013.01); *B63B 35/00* (2013.01); *E21B 19/00* (2013.01)

(58) Field of Classification Search
CPC ..... E21B 19/00; E21B 19/004; E21B 19/143; E21B 19/155; B63B 35/4413
See application file for complete search history.

(56) References Cited

U.S. PATENT DOCUMENTS 4,182,253 A * 1/1980 Bordes ..... B63B 25/00 114/72
4,202,653 A * 5/1980 Moller ..... B65G 1/0442 414/22.57
(Continued)

FOREIGN PATENT DOCUMENTS

KR 10-2013-0043773 A 5/2013
WO WO 2009/102196 A2 8/2009
(Continued)

OTHER PUBLICATIONS

"Riser Handling", Oct. 10, 2013, XP054975876, Retrieved from the Internet: URL: https://www.youtube.com/watch?v=XtqxU19VKfs, [retrieved on May 22, 2015], the whoe document.

*Primary Examiner* — Matthew R Buck
(74) *Attorney, Agent, or Firm* — Birch, Stewart, Kolasch & Birch, LLP

(57) ABSTRACT

A vessel is adapted to perform subsea wellbore related operations involving a riser string between the subsea wellbore and the vessel, e.g. drilling and/or wellbore intervention. The vessel includes a hull having a deck, and a riser storage hold present within the hull below the deck. The riser storage hold includes storage racks adapted to store therein parallel stacks of multiple riser sections and/or pre-assembled riser stands in horizontal orientation. The vessel has an elongated riser transfer opening between the deck and the roof, the riser transfer opening extending in a direction parallel to the storage racks, the riser transfer opening having a length and a width so as to allow for transfer of a single riser section or a single riser stand in horizontal orientation via the riser transfer opening out of and into the riser storage hold, wherein the risers' handling system is suitable to work at the same time with two different lengths.

17 Claims, 15 Drawing Sheets

(51) Int. Cl.
*B63B 35/44* (2006.01)
*B63B 35/00* (2006.01)

(56) References Cited

U.S. PATENT DOCUMENTS

| | | | | |
|---|---|---|---|---|
| 4,634,314 | A | 1/1987 | Pierce | |
| 5,183,122 | A * | 2/1993 | Rowbotham | E21B 15/045 175/52 |
| 6,926,488 | B1 * | 8/2005 | Bolding | E21B 19/15 211/70.4 |
| 7,905,529 | B2 * | 3/2011 | Reed | E21B 19/004 294/103.1 |
| 2013/0287499 | A1 * | 10/2013 | Fraczek | F16L 1/20 405/171 |

FOREIGN PATENT DOCUMENTS

| | | | |
|---|---|---|---|
| WO | WO 2012/168428 | A1 | 12/2012 |
| WO | WO 2014/146760 | A2 | 9/2014 |
| WO | WO 2014/168471 | A1 | 10/2014 |

* cited by examiner 68
65
67
66
70b
70a
95
68a
68b
85
61
60
62
63

SUBSEA WELLBORE OPERATIONS VESSEL

FIELD OF THE INVENTION

The present invention relates to a vessel adapted to perform subsea wellbore related operations involving a riser string between the subsea wellbore and the vessel, e.g. drilling and/or wellbore intervention.

The present invention also relates to a riser string extending between a vessel and a subsea wellbore.

BACKGROUND OF THE INVENTION

In the prior art it is common to store the multiple riser sections from which the subsea riser string is composed in a riser storage of the vessel.

Commonly a riser section comprises a riser pipe and in many known embodiments additionally one or more satellite or peripheral pipes on the outside of and along the riser pipe. The satellite pipes are e.g. used as fluid lines to a BOP or other subsea equipment, e.g. choke lines, kill lines, hydraulic lines, booster lines, injection lines (e.g. for glycol), etc. Each riser section comprises a connector fitting arrangement at each end thereof. For example the connector fitting arrangement includes a flange having bolt holes, with riser sections being joined by interconnecting flanges by means of bolts and nuts. A satellite pipe may have an individual connector fitting, e.g. a bayonet fitting, or be designed to fit sealingly into the satellite pipe of an adjoining riser section without direct axial securing of the satellite pipes. In many practical embodiments a riser section is provided with one or more buoyancy and/or thermal insulation members, e.g. of foam material, but so-called bare joints are also employed.

Riser sections come in different lengths. Commonly riser sections have lengths between 50 ft. (15.24 meters) and 90 ft. (27.43 meters). A very common length for riser sections is 75 ft. (22.86 meters).

Riser sections are commonly heavy; far heavier than other tubulars used in the offshore drilling industry. For example a single 75 ft. subsea riser section may weigh between 20 and 25 tonnes, which is incomparable to the weight of an equally long drill pipe. Therefore riser handling is subject to different considerations than drill pipe handling, mainly in view of their size (diameter) and weight.

For example WO2009/102196 discloses a mono-hull vessel having a hull and a riser storage hold within the hull. In the riser storage hull riser sections are stacked in their horizontal orientation. A gantry crane is provided to raise and lower the riser sections out of and into the storage hold and to place each individual riser section onto a riser catwalk machine or to pick up a riser section from the catwalk machine. The leading end of the riser section is in practice connected to a riser string lifting tool which connects the riser section to a riser string handling capacity hoisting device of the vessel. By raising the lifting tool and operation of the catwalk machine the riser section is brought into a vertical orientation, or upended, in line with a firing line along which the riser string is suspended into the sea. The already launched portion of the riser string is then temporarily held by a riser string hanger, often referred to as a riser spider, of the vessel. The new riser section is then held in alignment above the launched riser string and the connector fitting arrangements are interconnected to join the new riser section to the riser string. Then the riser string is released by the riser string hanger and lowered over the length of the newly attached section. The riser string is then suspended again from the riser string hanger and the process of joining a new riser section is repeated.

It has been found that this known process to assembly a riser string is time-consuming. In particular a great deal of effort has to be made to properly make up the connections between the connector fitting arrangements of the riser sections. In particular in view of desired or required testing of each connection that has been made up the known process is undesirably slow.

OBJECT OF THE INVENTION

The present invention aims to propose measures that allow for improvements over the known approach, in view of pace with which the riser string can be assembled and/or disassembled, as well as in view of the actual storing and/or handling of riser sections on board a vessel.

SUMMARY OF THE INVENTION

The first aspect of the invention proposes a vessel adapted to perform subsea wellbore related operations involving a riser string between a subsea wellbore and the vessel, said vessel comprising:

- a hull having a deck,
- a riser storage hold present within said hull below said deck, which riser storage hold comprises storage racks adapted to store therein parallel stacks of multiple riser sections and/or pre-assembled riser stands in a horizontal orientation, which riser storage hold has a floor, side walls, and a roof,

- an elongated riser transfer opening between said deck and said roof, said riser transfer opening extending in a direction parallel to said storage racks, said riser transfer opening having a length and a width so as to allow for transfer of a single riser section or a single riser stand in said horizontal orientation thereof via said riser transfer opening out of and into the riser storage hold,
- a riser transfer station arranged within said riser storage hold below said riser transfer opening and provided with a transfer elevator that is adapted to raise and lower a single riser section or a single riser stand in said horizontal orientation thereof so as to pass the riser section or a riser stand through the riser transfer opening,
- a first overhead travelling beam crane arranged within the riser storage hold, said first overhead travelling beam crane being adapted to lift and lower a single riser section or a single riser stand at least allowing for removal of a single riser section or a single riser stand riser stand from a storage rack and for placing a single riser section or a single riser stand into a storage rack respectively, and said first crane being adapted for transverse transportation of a single riser section or a single riser stand at least between said transfer station and a position above a storage rack, wherein said first overhead travelling beam crane comprises:

- a travelling beam extending in a direction parallel to said storage racks and supported at each end thereof on a crane rail which extends perpendicular to said storage racks,
- a winch trolley provided with one or more winches and displaceable along said travelling beam,
- an elongated gripper frame suspended by one or more winch driven cables from said winch trolley, said gripper frame being provided with multiple riser grippers adapted to engage on a single riser section or a single riser stand at spaced gripping locations thereof, wherein the riser storage hold is provided with first length storage racks adapted to store therein single first length riser sections and/or pre-assembled riser stands each having a length of at least 100 ft. (30.48 m), and wherein the riser storage hold is provided with second length storage racks adapted to store therein single second length riser sections each having a length of between 50 ft. (15.24 meters) and 90 ft. (27.43 meters), and wherein the first overhead travelling beam crane is adapted to transfer a second length riser section between each of said second length storage racks and the transfer station, and to transfer a first length riser section or riser stand between each of said first length storage racks and the transfer station.

Due to the presence of both first length storage racks as well as second length storage racks the vessel can store both single first length riser sections and/or pre-assembled riser stands (62) each having a length of at least 100 ft. (30.48 m), e.g. of 120 ft. (36.57 m) or 150 ft. (45.72 m), and single second length riser sections each having a length of between 50 ft. (15.24 meters) and 90 ft. (27.43 meters), e.g. of 75 ft. (22.86 meters). In a very practical embodiment there are storage racks dedicated to 150 ft. (45.72 m) riser sections and/or pre-assembled riser stands and storage racks dedicated to 75 ft. (22.86 meters) riser sections.

The riser storage may include at opposed ends of the space for storage of pre-assembled riser stands a platform assembly with personnel accessible platforms at multiple levels so as to allow access of personnel to the connector fitting arrangements at the ends of the riser stands.

For example the riser stand transfer opening has a width between 1.5 and 4.0 meters.

The riser transfer opening will have a length at least equal to first length riser section or stand, e.g. a length of about 50 meters for the passage of 150 ft. (45.72 m) riser sections and/or pre-assembled riser stands.

The first, possibly only, overhead travelling beam crane is adapted to transfer a second length riser section between each of the second length storage racks and the transfer station, and to transfer a first length riser section or riser stand between each of the first length storage racks and the transfer station.

In a preferred embodiment two second length storage racks are arranged in line with one another, parallel to the first length storage racks. This allows for efficient use of the volume within the hull of the vessel and efficient access to said second length storage racks by the overhead crane.

In an embodiment the vessel has stored both first length riser sections and/or pre-assembled riser stands each having a length of at least 100 ft. (30.48 m), e.g. of 120 ft. (36.57 m) or 150 ft. (45.72 m), and second length single riser sections each having a length of between 50 ft. (15.24 meters) and 90 ft. (27.43 meters), e.g. of 75 ft. (22.86 meters).

For example, and as preferred, each riser stand consists of two riser sections, preferably equally long single riser sections. Each single riser section comprises a riser pipe and optionally one or more satellite pipes on the outside of and along the riser pipe. Each riser section comprises a connector fitting arrangement at each end thereof. Preferably each riser section comprises one or more buoyancy members.

Through the use of first length riser sections or pre-assembled riser stands stored in the riser storage the time needed for deployment and/or retrieval of a riser string is reduced compared to the present practice wherein second length riser sections are interconnected in the firing line. The use of first length riser sections or pre-assembled riser stands for example allows to bring up the blow-out preventer or a module thereof attached to the lower end of the riser string without causing undue delay of the drilling process. The blow out preventer or module thereof can then, e.g., be subject to inspection and/or maintenance, which enhances safety of subsea drilling, e.g. in great water depths. Also great progress is made in the deployment process in view of repetitive testing of the leak tightness of the riser string, which is commonly done after three new riser sections have been added to the string. With the use of first length riser sections or pre-assembled riser stands a significant reduction of the number of pressure tests may be required, or testing may be done with less time pressure per test to be performed.

In order to benefit optimally from the invention it is envisaged that the main storage of riser sections onboard the vessel is embodied as storage for first length riser sections or pre-assembled riser stands, so that a majority, e.g. at least 60%, of the riser string length that is stored onboard the vessel, is stored as these first length riser sections or riser stands. For example the storage racks are embodied to store therein at least 6000 ft. in total of first length riser sections or stands, e.g. at least 40 riser sections or stands of 150 ft. each.

The storage racks may also be embodied to store therein at least 1500 ft. in total of second length riser sections, e.g. at least 20 riser sections of 75 ft. each.

Possibly also some so-called pup sections of very limited length that are commonly employed in the industry can be stored onboard, e.g. within the riser storage hold.

Further riser string items like a telescopic joint, hang-off joint, etc. can also be stored onboard the vessel.

It is noted that in non-prepublished PCT/NL2014/050201 a vessel is disclosed having a riser storage hold within the hull below the deck. The riser storage hold comprises storage racks adapted to store therein parallel stacks of multiple riser sections and/or pre-assembled riser stands in horizontal orientation. The vessel is provided with an elongated riser transfer opening between the deck and the roof of the storage hold. This riser transfer opening extends in a direction parallel to the storage racks and has a length and a width so as to allow for transfer of a single riser section or a single riser stand in horizontal orientation via the riser transfer opening out of and into the riser storage hold. The vessel is further provided with a riser transfer station arranged within the riser storage hold below the riser transfer opening. This station is provided with a transfer elevator that is adapted to raise and lower a single riser section or a single riser stand in horizontal orientation thereof so as to pass the riser section or a riser stand through the riser transfer opening. Within the riser storage hold an overhead travelling beam crane is arranged, which crane is adapted to lift and lower a single riser section or a single riser stand at least allowing for removal of a single riser section or a single riser stand riser stand from a storage rack and for placing a single riser section or a single riser stand into a storage rack respectively. The crane is also adapted for transverse transportation of a single riser section or a single riser stand at least between the transfer station and a position above a storage rack.

In an embodiment the transfer elevator comprises a first elevator unit and a second elevator unit, which units are spaced apart in a direction parallel to the storage racks. Each of the first and second elevator units are adapted to selectively operate stand-alone or in unison. When operating in stand-alone mode each elevator unit is used to raise and lower a second length riser section, e.g. a 75 ft. (22.86 meters) riser section. When operating in unison the first and second elevator units are used to raise and lower a first length riser section or single first length riser stand, e.g. a 150 ft. (45.72 m) riser section and/or pre-assembled riser stand.

Each elevator unit, in an embodiment, comprises a vertical guide structure, preferably stationary mounted in the storage hold, and a telescoping member which is guided by the vertical guide structure. A riser support member is mounted on the telescoping member and is adapted to support a riser section or riser stand thereon.

In an embodiment the elevator unit further comprises a winch and winch driven cable connected to the telescoping member to cause vertical motion thereof. For example, in view of redundant construction, two winches may operate a single winch driven cable, e.g. each winch attached to a different cable end, so that operations can continue in case of winch failure. In an alternative one can envisage a rack-and-pinion drive for the telescoping member or e.g. one or more hydraulic cylinders.

In an embodiment a riser support member is a riser support table having a length of between 20 and 50 ft. The significant length may allow to engage the riser support table directly with one or more buoyancy members fitted on the riser section or riser stand as the load is then distributed over a significant area.

In an embodiment the riser support member is pivotally connected to the telescoping member and tiltable between a horizontal operation position wherein a riser section or riser stand can rest on said riser support member and a vertical inoperative storage position.

In an embodiment a first group of first length storage racks is arranged adjacent one side of the transfer station and a second group of first length storage racks is arranged adjacent another side of the transfer station. This allows for a relative short distance of travel of the first length riser sections or stand between their respective storage rack and the transfer station. This enhances operating speed when handling the long and heavy first length riser sections and/or stands.

In an embodiment a first group of second length storage racks is arranged along the first group of first length storage racks and a second group of second length storage racks is arranged along the second group of first length storage racks.

In an embodiment a group of second length storage racks is arranged along a port side of the hold and another group of second length storage racks along a starboard side of the hold. One or more groups of first length storage racks are then arranged between said port and starboard side groups of second length storage racks. This means that the longest riser sections or stands are arranged more in the center of the hold, with the shorter second length riser section along the port and starboard sides of the hold. This e.g. is favourable in view of the handling of the longest first length riser sections or stand, e.g. when a transfer opening through deck is arranged centrally on the vessel.

As will explained below, in an embodiment, it is envisaged that the relative shorter, nowadays common, second length riser sections will be provided with buoyancy members that are to be fitted in a lower part of the riser string, so with buoyancy members that have a high depth rating. Commonly buoyancy members have increasing specific weight and overall mass as the depth rating increases in view of the water pressure to which the buoyancy member is subjected which increases with water depth. It is envisaged that fitting first length riser sections or first length riser stands stored in the storage with high depth rating buoyancy members would result in a total weight of each riser section or riser stand that renders the handling thereof very difficult, e.g. in view of sagging when held horizontally when conveyed by an overhead beam crane. Therefore, in an embodiment, it is envisaged that multiple first length riser sections or riser stands and multiple second length riser sections are each provided with buoyancy modules, wherein the buoyancy modules of the second length riser sections have a greater depth rating than the buoyancy modules of the first length riser sections. So the shorter elements have the relatively heavy buoyancy members and the longer elements of the riser string have the relative light buoyancy members, so that handling of both can be done effectively.

The present invention also envisages a riser string extending between a subsea wellbore and a subsea wellbore operations vessel, wherein the riser string comprises a lower string part composed of interconnected second length riser sections and an upper string part composed of interconnected first length riser sections or riser stand, wherein said first length riser sections or riser stand and said second length riser sections are each provided with buoyancy modules, and wherein the buoyancy modules of the second length riser sections having a greater depth rating than the buoyancy modules of the first length riser sections. It will be appreciated that such riser string can be assembled effectively when using a vessel as described herein.

In an embodiment each storage rack comprises at ends thereof a pair of adjacent riser end support columns that form a vertical slot which is adapted to receive therein an end portion, e.g. a flange, of a riser section or riser stand.

In an embodiment the riser storage hold is provided with at least one elongated riser workshop having a floor, preferably also walls and a possibly also a roof.

The riser workshop is arranged parallel to the storage racks and the workshop is adapted to accommodate at least one riser section or riser stand in horizontal orientation, preferably at least one first length riser section or riser stand, e.g. a 150 ft. length.

The workshop provides a space, preferably an enclosure, for personnel performing work on the riser, e.g. maintenance and/or inspection of the riser and/or assembly of two riser sections to form a pre-assembled riser stand.

In an embodiment the first overhead travelling beam crane is adapted to place a riser in the workshop and remove a riser from the workshop, e.g. the workshop having a roof with a riser transfer opening therein, preferably said opening being provided with a mobile roof cover, e.g. one or more hatches or a tarpaulin.

In a further embodiment a first elongated riser workshop and a second elongated riser workshop are arranged in the riser storage hold, along opposite sides of the storage racks, preferably with the transfer station centrally between storage racks. The arrangement of riser workshops to the sides of the storage racks, e.g. along port and starboard side of the hull in a monohull vessel, allows for effective use of space, reduced crane handling distances, and enhances access to the workshops for personnel.

In an embodiment the riser storage hold is provided, in addition to the first overhead travelling beam crane, with a second overhead travelling beam crane arranged within the riser storage hold. This second crane is also adapted to lift and lower a single riser section or a single riser stand at least allowing for removal of a single riser section or a single riser stand riser stand from a storage rack and for placing a single riser section or a single riser stand into a storage rack respectively. The second crane is also adapted for transverse transportation of a single riser section or a single riser stand at least between said transfer elevator and a position above a storage rack. The second crane comprises:

a second travelling beam extending in a direction parallel to said storage racks and supported at each end thereof on a crane rail perpendicular to said storage racks, preferably the same crane rail as the first overhead travelling beam crane, a second winch trolley provided with one or more winches and displaceable along said travelling beam, possibly, an elongated gripper frame suspended by one or more winch driven cables from said winch trolley, said gripper frame being provided with multiple riser grippers adapted to engage on a single riser section or a single riser stand at spaced gripping locations thereof.

The provision of the second crane creates a redundant crane system, which can continue to operate should the first crane have a failure. One can envisage that the gripper frame is then fitted onto the second crane, but also each crane can have its own gripper frame to allow for a rapid changeover to the other crane. The provision of the second crane is in particular advantageous when a first elongated riser workshop and a second elongated riser workshop are arranged in the riser storage hold, at least one of said riser workshop being arranged along a side of the riser storage hold, and when the second travelling beam crane has a parking position above said workshop along the side of the riser storage hold. Most preferred is an embodiment wherein the other workshop is along the opposite side of the riser storage hold so that the crane that is not in use is parked at the side of the hold above the workshop with the other workshop still accessible by means of the operational crane.

In an embodiment the vessel is provided with one or more movable hatches which in a closed position thereof close the transfer opening and in an opened position thereof open the transfer opening, e.g. pivotal hatches.

In an embodiment the gripper frame is provided with two riser grippers that are adapted and arranged to engage on the end portions of second length riser section, e.g. on end portions of a 75 ft. riser section. For example use is made of a riser gripper as disclosed in U.S. Pat. No. 7,905,529. In another embodiment which is preferred, it is envisaged that the riser grippers are each embodied to cooperate with a hook that is fitted on the riser section or riser stand, e.g. a hook integrated with a collar that is fitted around the riser pipe.

In an embodiment one or more, preferably all, of the first length riser sections or riser stands are provided at intermediate locations along the length thereof with two riser gripper engageable portions, e.g. with a hook at each location, having a spacing the same as the spacing between end portions of a second length riser section so as to allow the two riser grippers to engage on these gripper engageable portions of the first length riser section or riser stand. So in an embodiment the riser grippers are arranged on the gripper frame to engage end portions, e.g. provided with hooks, of a 75 ft. riser section, with the vessel also storing 150 ft. riser sections or stand that are provided with two gripper engageable portions, e.g. hooks, at the same spacing or at least a spacing that approximates said 75 ft. end portion spacing.

In an embodiment, in particular with the first length riser section having at intermediate locations along the length thereof with two riser gripper engageable portions, the gripper frame is provided, at each end thereof, with a telescoping extender having an extender end, which extender is extensible so that the extender end is adjacent the end of a first length riser section or riser stand. The extender is preferably used to cooperate with the storage racks to guarantee vertical guidance of the gripper frame and riser section or stand held thereby during lifting and lowering.

In an embodiment each first length storage rack comprises at ends thereof a pair of adjacent riser end support columns that form a vertical slot which is adapted to receive therein an end portion, e.g. a flange, of a riser section or riser stand, and wherein the extender end is adapted to be slidingly received between these columns.

In an embodiment substantially horizontal rails extend along opposite longitudinal sides of the riser transfer opening, and the vessel comprises a riser horizontal transport device that is mounted on these horizontal rails and movable there along. The device is adapted to receive and hold a riser section or riser stand that has been raised through the transfer opening by the riser elevator and to horizontally transport the riser section or riser stand so that a leading end thereof is connectable to a riser string lifting tool that is adapted to support the weight of a riser string in a firing line of the vessel.

In an embodiment the riser horizontal transport device comprises a strongback assembly as is disclosed in non-prepublished PCT/NL2014/050201, which disclosure is incorporated herein by reference.

In another embodiment the riser horizontal transport device comprises a catwalk machine having a mobile catwalk machine frame that is movable over said horizontal rails, wherein the catwalk machine frame has a rear end and a front end, and is movable over the horizontal rails at least in a loading position and in a riser upending position. The catwalk machine frame has two parallel and horizontal frame beams, and a skate is supported by said frame beams and travels over the frame beams. The skate comprises a riser end support to support thereon a rearward end of a riser section or riser stand. The horizontal frame beams of the catwalk machine frame define between them an opening having a width so as to allow for the vertical passing of a single riser section or a single riser stand in horizontal orientation through said opening, preferably by means of the transfer elevator.

In addition to the skate the catwalk machine comprises one or more additional riser support members that are movable between an inactive position allowing for the mentioned vertical passage of the single riser section or single riser stand and an active position wherein the riser section or riser stand is supported on said riser support member.

The frame beams of the catwalk machine are rigidly interconnected by a transverse beam near the rear end of the catwalk machine frame, and the frame beams are interconnected by one or more mobile transverse connectors that are each movable between an inactive position allowing for said vertical passage of the single riser section or single riser stand and an active position wherein the transverse connector interconnects the frame beams, e.g. the catwalk machine frame having a single transverse connector at the front end of the catwalk machine frame. The provision of one or more mobile transverse connectors allows for the length of the catwalk machine frame to be significantly less than the length of the transfer opening and less than the length of the first length riser section or riser stand as the first length element can pass in vertical direction, e.g. by means of the transfer elevator, when the connectors are in their inactive position.

In an embodiment the catwalk machine is provided with a tailing-in arm device that is mounted at the forward end of the catwalk machine frame. For example one tailing-in arm is arranged on each main beam of the frame, with the arms being movable into an operative position to act in unison when tailing-in the riser section or stand during the last stage of the upending process. The mounting on the catwalk machine causes the tailing-in arm device to move along with the catwalk machine, and thus it forms no obstacle near the firing line when the catwalk machine is retracted, e.g. when not in use. In an alternative the tailing-in arm device is supported on the vessel in a different manner, e.g. mobile in the tower.

In an embodiment the vessel is provided with one or more movable hatches which in a closed position thereof close the transfer opening and in an opened position thereof open the transfer opening, e.g. pivotal hatches.

In an embodiment a first set of pivotal hatches is arranged along one longitudinal side of the transfer opening and a second set of pivotal hatches is arranged along the opposed longitudinal side of the transfer opening, so that with said hatches in horizontal position the transfer opening is closed and with said hatches in upward or downward pivoted position the transfer opening is open.

In an embodiment with upwardly opening pivoting hatches for the transfer opening it is envisaged that with said hatches in upward pivoted position said hatches are to the outside of the horizontal rails at a spacing allowing for the travel of the catwalk machine over said horizontal rails between said upward pivoted hatches.

In an embodiment the vessel is a monohull vessel and the riser storage is embodied to store the riser section and/or riser stands therein parallel to a longitudinal axis of the vessel.

In an embodiment the transfer opening is on the longitudinal midplane of the monohull vessel, preferably with the riser assembly firing line of the vessel also in said midplane.

In an embodiment the vessel has a moonpool and a tower is arranged at the moonpool, e.g. at a side of the moonpool or above the moonpool, e.g. as in WO2009/102196.

In an embodiment the vessel is provided with a riser string hanger that is adapted to suspended therefrom a riser string in a firing line into the sea.

In an embodiment the vessel has a tower, e.g. at a moonpool or above a moonpool, with the riser string assembly firing line e.g. extending through the moonpool, and a firing line hoisting device is provided, the hoisting device comprising a hanger device that is movable up and down relative to the tower. Preferably the hanger device is embodied as a travelling hanger device that is movable up and down along one or more vertical rails mounted on the tower, e.g. a wheeled travelling hanger device having wheels engaging one or more vertical rails. Preferably the hoisting device comprises at least one winch and at least one cable, wherein the hanger device is suspended from the at least one cable.

In an embodiment the moonpool has lateral sides, a front side and a rear side, and the tower is embodied as a hollow construction mast having a top and having a base that is integral with the hull, the base extending between sections of the hull on opposed lateral sides of the moonpool, the base being spaced from each of the front side and the rear side of the moonpool, thereby forming a front moonpool area forward of the mast and a rear moonpool area rearward of the mast, wherein the mast has a front side and an opposed rear side as well as opposed lateral sides. At one of said moonpool areas, preferably the rear moonpool area, the vessel is provided with a riser string assembly hanger that is adapted to suspended therefrom a riser string in a firing line into the sea during the riser assembly and disassembly process.

In a preferred embodiment the vessel has a riser string handling capacity hoisting device including a riser string lifting tool which is movable up and down relative to the mast and that is adapted to connect to an end of a riser section, preferably of a pre-assembled riser stand, and is embodied to support the weight of a riser string in the firing line when released from the riser string assembly hanger.

In a preferred embodiment the vessel has a second firing hoisting device, having a load attachment device which is movable up and down relative to the mast at a side opposed from the riser firing line, so as to allow for handling of items passing through the other moonpool area along a second firing line distinct and spaced from the first firing line where the riser string assembly takes place. Preferably said second hoisting device is embodied as a drilling drawworks, and is provided with a topdrive suspended from the load attachment device to perform drilling operations.

Preferably the vessel has a moonpool and the vessel is provided with a riser string support cart that is displaceable within the moonpool between the two firing lines allowing to assembly a riser string in a riser string assembly firing line, e.g. at the rear moonpool area, and then to transfer the riser string to a drilling firing line, e.g. at a front moonpool area. For example this cart is embodied as a skid cart that can be skidded over a pair of associated skid rails which extend in longitudinal direction along the moonpool, allowing to displace the cart in longitudinal direction of the moonpool while supporting a riser string (and preferably with a BOP attached to the lower end of the riser string) lowered into the sea, generally between the one moonpool area and the other moonpool area, so underneath the base of the mast.

In an embodiment the riser string support cart is also embodied to support a blow-out preventer or blow-out preventer module thereon, so with the cart underneath the blow-out preventer or module thereof.

Preferably one or both of the riser string handling capacity hoisting devices and—if present—the second firing line hoisting device comprises one or more cables and one or more associated winches.

Preferably one or both of the riser string handling capacity hoisting devices and—if present—the second firing hoisting device comprises a heave compensation mechanism.

It is envisaged that—if present—the riser transfer opening is oriented with its length towards the moonpool, preferably along or parallel to a central axis of the vessel if the vessel is a monohull vessel. E.g. the vessel has a riser storage hold aft of the moonpool.

In an embodiment the vessel has a moonpool. At the moonpool a tower, e.g. a hollow construction mast, is arranged. The vessel is provided with a riser string hanger that is adapted to suspended therefrom a riser string in a firing line through the moonpool into the sea. A hoisting device is provided having a hanger device that is movable up and down relative to the tower, e.g. the hanger device being suspended from a cable connected to one or more winches.

A second aspect of the present application relates to a vessel adapted to perform subsea wellbore related operations involving a riser string between the subsea wellbore and the vessel, e.g. drilling and/or wellbore intervention, said vessel comprising a hull having a deck, said vessel comprising:

- a riser storage hold present within said hull below said deck, which riser storage hold comprises storage racks adapted to store therein parallel stacks of multiple riser sections and/or pre-assembled riser stands in horizontal orientation, which riser storage hold has a floor, side walls, and a roof, wherein the riser storage hold is provided with first length storage racks adapted to store therein single first length riser section and/or pre-assembled riser stands (62) each having a length of at least 100 ft. (30.48 m), e.g. of 120 ft. (36.57 m) or 150 ft. (45.72 m), and wherein the riser storage hold is provided with second length storage racks adapted to store therein single second length riser sections each having a length of between 50 ft. (15.24 meters) and 90 ft. (27.43 meters), e.g. of 75 ft. (22.86 meters), wherein two second length storage racks are arranged in line, parallel to said first length storage racks.

The present invention also relates to a vessel adapted to perform subsea wellbore related operations involving a riser string between the subsea wellbore and the vessel, e.g. drilling and/or wellbore intervention, said vessel comprising a hull having a deck, said vessel comprising:

a riser storage hold present within said hull below said deck, which riser storage hold comprises storage racks adapted to store therein parallel stacks of multiple riser sections and/or pre-assembled riser stands in horizontal orientation, which riser storage hold has a floor, side walls, and a roof, a first overhead travelling beam crane arranged within the riser storage hold, said first crane being adapted to lift and lower a single riser section or a single riser stand at least allowing for removal of a single riser section or a single riser stand riser stand from a storage rack and for placing a single riser section or a single riser stand into a storage rack respectively, and said crane being adapted for transverse transportation of a single riser section or a single riser stand at least between said transfer elevator and a position above a storage rack, wherein said first crane comprises:

a travelling beam extending in a direction parallel to said storage racks and supported at each end thereof on a crane rail perpendicular to said storage racks a winch trolley provided with one or more winches and displaceable along said travelling beam, an elongated gripper frame suspended by one or more winch driven cables from said winch trolley, said gripper frame being provided with multiple riser grippers adapted to engage on a single riser section or a single riser stand at spaced gripping locations thereof, and wherein the riser storage hold is provided with a second overhead travelling beam crane arranged within the riser storage hold, said second crane being adapted to lift and lower a single riser section or a single riser stand at least allowing for removal of a single riser section or a single riser stand riser stand from a storage rack and for placing a single riser section or a single riser stand into a storage rack respectively, and said second crane (50) being adapted for transverse transportation of a single riser section or a single riser stand at least between said transfer elevator and a position above a storage rack, wherein said second crane comprises:

a second travelling beam extending in a direction parallel to said storage racks and supported at each end thereof on a crane rail perpendicular to said storage racks, preferably the same crane rail as the first overhead travelling beam crane, a second winch trolley provided with one or more winches and displaceable along said travelling beam, possibly, an elongated gripper frame suspended by one or more winch driven cables from said winch trolley, said gripper frame being provided with multiple riser grippers adapted to engage on a single riser section or a single riser stand at spaced gripping locations thereof, A third aspect of the present invention relates to a vessel adapted to perform subsea wellbore related operations involving a riser string between the subsea wellbore and the vessel, e.g. drilling and/or wellbore intervention, said vessel comprising a hull having a deck, said vessel comprising:

a riser storage hold present within said hull below said deck, which riser storage hold comprises storage racks adapted to store therein parallel stacks of multiple riser sections and/or pre-assembled riser stands in horizontal orientation, which riser storage hold has a floor, side walls, and a roof, an elongated riser transfer opening between said deck and said roof, said elongated riser transfer opening extending in a direction parallel to said storage racks, and said elongated riser transfer opening having a length and a width so as to allow for transfer of a single riser section or a single riser stand in horizontal orientation via said riser transfer opening out of and into the riser storage hold, a riser transfer station arranged within said riser storage hold and provided with a transfer elevator that is adapted to raise and lower a single riser section or a single riser stand in horizontal orientation thereof so as to pass the single riser section or a single riser stand through the riser transfer opening, a first crane arranged within the riser storage hold, said first crane being adapted to lift and lower a single riser section or a single riser stand at least allowing for removal of a single riser section or a single riser stand riser stand from a storage rack and for placing a single riser section or a single riser stand into a storage rack respectively, and said first crane being adapted for transverse transportation of a single riser section or a single riser stand at least between said transfer elevator and a position above a storage rack, wherein the riser storage hold is adapted to store therein single first length riser section and/or pre-assembled riser stands (62) each having a length of at least 100 ft. (30.48 m), e.g. of 120 ft. (36.57 m) or 150 ft. (45.72 m), and wherein the riser storage hold is adapted to store therein single second length riser sections each having a length of between 50 ft. (15.24 meters) and 90 ft. (27.43 meters), e.g. of 75 ft. (22.86 meters), wherein the transfer elevator comprises a first elevator unit and a second elevator unit that are spaced apart in a direction parallel to said storage racks, wherein each of said first and second elevator units are adapted to selectively operate stand-alone or in unison, wherein, for operating stand-alone, each elevator unit is adapted to raise and lower a second length riser section, and wherein, for operating in unison, said first and second elevator units are further adapted to raise and lower a first length riser section or single riser stand.

A fourth aspect of the present invention relates to a vessel adapted to perform subsea wellbore related operations involving a riser string between the subsea wellbore and the vessel, e.g. drilling and/or wellbore intervention, said vessel comprising a hull having a deck, said vessel comprising:

a riser storage hold present within said hull below said deck, which riser storage hold comprises storage racks adapted to store therein parallel stacks of multiple riser sections and/or pre-assembled riser stands in horizontal orientation, which riser storage hold has a floor, side walls, and a roof, an elongated riser transfer opening extending between said deck and said roof, said elongated riser transfer opening being a parallel to said storage racks, and said elongated riser transfer opening having a length and a width so as to allow for transfer of a single riser section or a single riser stand in horizontal orientation via said riser transfer opening out of and into the riser storage hold, a riser transfer station arranged within said riser storage hold and provided with a transfer elevator that is adapted to raise and lower a single riser section or a single riser stand in horizontal orientation thereof so as to pass the single riser section or a single riser stand through the riser transfer opening, wherein a first elongated riser workshop and a second elongated riser workshop are arranged in the riser storage hold, wherein each riser workshop has a floor, preferably also walls and a possibly also a roof, the first and second workshop each being arranged along a side of the storage hold, the storage racks being positioned between said first and second workshops, wherein each riser workshop is arranged parallel to the storage racks and the workshop is adapted to accommodate at least one riser section or riser stand in horizontal orientation, the workshop providing a space, preferably an enclosure, for personnel performing work on the riser, e.g. maintenance and/or inspection of the riser, wherein the vessel comprises a crane is adapted to place a riser in the workshop and remove a riser from the workshop, e.g. the workshop having a roof with a riser transfer opening therein, preferably said opening being provided with a mobile roof cover, e.g. one or more hatches or a tarpaulin.

wherein, preferably, the transfer station is located centrally between storage racks.

A fifth aspect of the present invention relates to a vessel adapted to perform subsea wellbore related operations involving a riser string between the subsea wellbore and the vessel, e.g. drilling and/or wellbore intervention, said vessel comprising a hull having a deck, said vessel comprising:

a riser storage, which riser storage comprises storage racks adapted to store therein parallel stacks of multiple riser sections and/or pre-assembled riser stands in horizontal orientation, wherein the riser storage is provided with first length storage racks wherein single first length riser section and/or pre-assembled riser stands (62) each having a length of at least 100 ft. (30.48 m), e.g. of 120 ft. (36.57 m) or 150 ft. (45.72 m) are stored, and wherein the riser storage is provided with second length storage racks wherein single second length riser sections each having a length of between 50 ft. (15.24 meters) and 90 ft. (27.43 meters), e.g. of 75 ft. (22.86 meters) are stored, a first overhead travelling beam crane adapted to lift and lower a single riser section or a single riser stand at least allowing for removal of a single riser section or a single riser stand riser stand from a storage rack and for placing a single riser section or a single riser stand into a storage rack respectively, and said first crane being adapted for transverse transportation of a single riser section or a single riser stand, wherein said first crane comprises:

a travelling beam extending in a direction parallel to said storage racks and supported at each end thereof on a crane rail perpendicular to said storage racks, a winch trolley provided with one or more winches and displaceable along said travelling beam, an elongated gripper frame suspended by one or more winch driven cables from said winch trolley, said gripper frame being provided with two riser grippers, wherein the first length riser sections or riser stands are each provided at intermediate locations along the length thereof with two riser gripper engageable portions having a spacing the same as the spacing between end portions of a second length riser section so as to allow said two riser grippers to engage on said gripper engageable portions of the first length riser section or riser stand.

A sixth aspect of the present invention relates to a single riser section having a length of at least 100 ft. (30.48 m), e.g. of 120 ft. (36.57 m) or 150 ft. (45.72 m), wherein the riser section is provided at intermediate locations along the length thereof with two riser gripper engageable portions having a spacing corresponding to the spacing between end portions of a 75 ft. (22.86 meters) riser section.

In an embodiment each gripper engageable portion comprises a hook member fitted to the riser section or riser stand, e.g. a hook integrated with a collar that is fitted around the riser pipe.

A seventh aspect of the present invention relates to a set of multiple first length riser sections or pre-assembled riser stands and multiple second length riser sections which are each provided with buoyancy modules, e.g. stored horizontally onboard a vessel, e.g. a vessel as disclosed herein, wherein the buoyancy modules of the second length riser sections having a greater depth rating than the buoyancy modules of the first length riser sections.

An eights aspect of the present invention relates to a riser string extending between a subsea wellbore and a subsea wellbore operations vessel, wherein the riser string comprises a lower string part composed of interconnected second length riser sections and an upper string part composed of interconnected first length riser sections or riser stand, wherein said first length riser sections or riser stand and said second length riser sections are each provided with buoyancy modules, and wherein the buoyancy modules of the second length riser sections having a greater depth rating than the buoyancy modules of the first length riser sections.

Each aspect of the present invention also relates to a method for assembly of a riser string, wherein use is made of a vessel and/or riser sections and/or pre-assembled riser stands as disclosed herein.

The present invention also relates to a riser catwalk machine as described herein. The present invention also relates to a vessel having a deck and a riser storage hold below said deck, wherein first length riser as described herein are stored in horizontal orientation in said storage hold, wherein a riser transfer opening is provided between the hold and the deck and wherein a riser catwalk machine is provided as described herein.

The present invention also relates to a riser handling overhead travelling beam crane as described herein. The present invention also relates to handling first and second length riser sections or pre-assembled riser stands as described herein using said overhead travelling beam crane, e.g. within a riser storage hold of a vessel.

It will be appreciated that any feature described with reference of one aspect of the invention, e.g. described as an optional or a required feature with respect to the first aspect of the invention, may be readily combined with one or more of the other aspects of the invention as described herein.

The invention will now be explained with reference to the drawings.

DETAILED DESCRIPTION OF EMBODIMENTS

Figure 1:
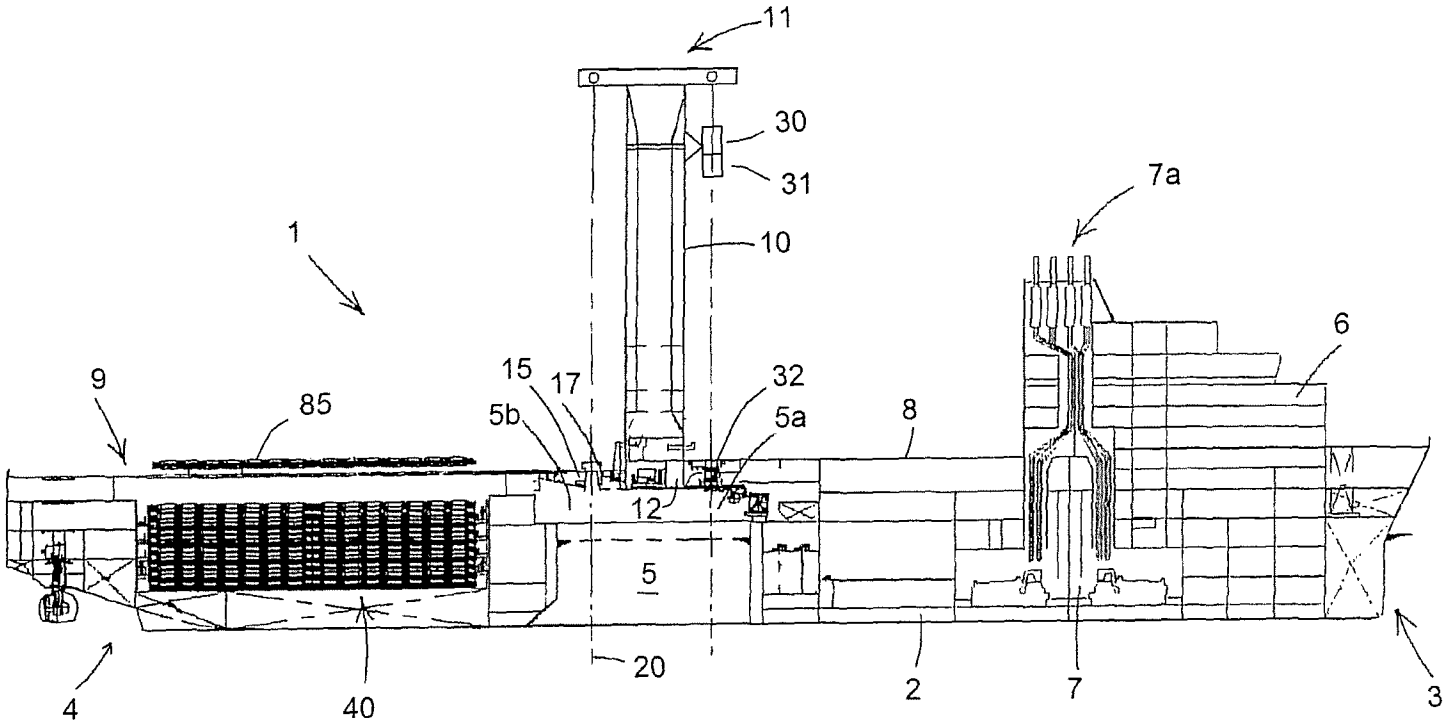
FIG. 1 shows in longitudinal view a vessel according to the invention.
Figure 2:
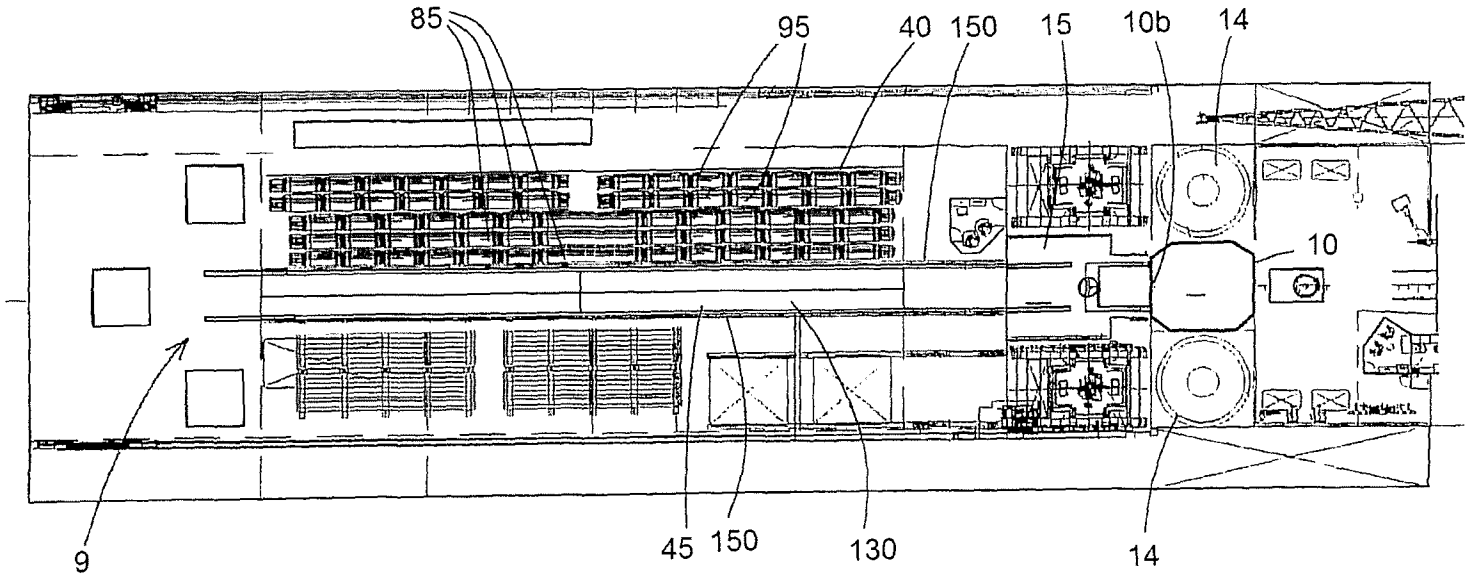
FIG. 2 shows a plan view of the aft part of the vessel of FIG. 1.
Figure 3:
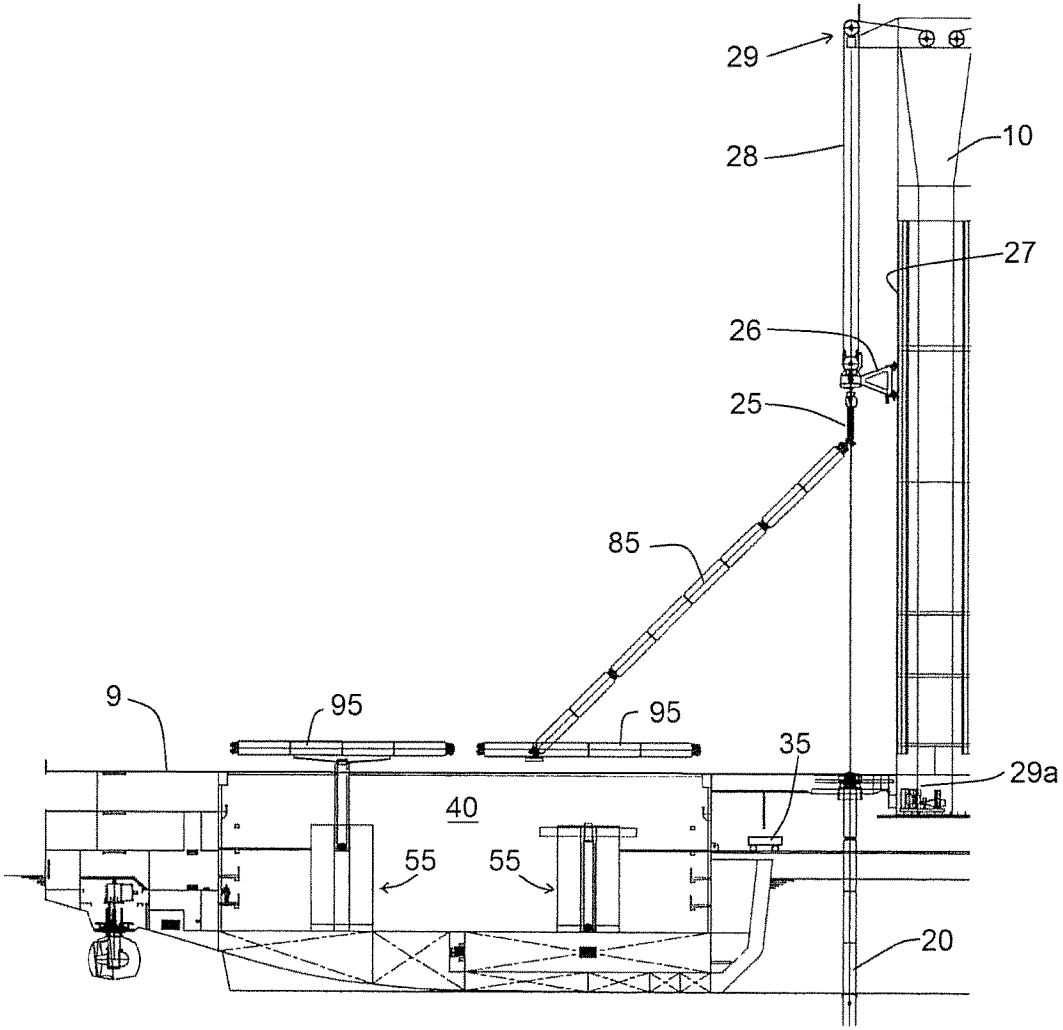
FIG. 3 shows schematically a step in a riser upending process of the vessel of FIG. 1.

FIG. 1 shows a mono-hull vessel 1 having a hull 2 with a bow 3, a stern 4, and a moonpool 5 that extends through the hull 1.

The vessel 1 is adapted to perform subsea wellbore related operations involving a riser string between the subsea wellbore and the vessel, in particular drilling operations, e.g. for exploratory drilling. The vessel can also perform other subsea wellbore related operations, e.g. wellbore intervention.

In this example, the vessel 1 has an accommodation topside 6 at the bow 3, including crew quarters and a bridge.

The vessel 1 has an engine room 7, generally below the accommodation topside, with exhausts 7*a* extending at the rear of the topside 6, above the topside 6.

The moonpool 5 has, as is preferred, a rectangular shape with opposed lateral sides, a front side and a rear side.

A front main deck 8 extends between the moonpool 5 and the topsides.

A rear main deck 9 extends between the moonpool 5 and the stern of the vessel 4.

The vessel is equipped with a tower 10, which is, as is preferred, embodied as a hollow construction mast having a top 11 and having a base 12 that is integral with the hull 2. The base 12 extends between sections of the hull on opposed lateral sides of the moonpool 5 and the base 12 is spaced from each of the front side and the rear side of the moonpool, thereby forming a front moonpool area 5*a* forward of the mast 10 and a rear moonpool area 5*b* rearward of the mast 10.

The mast 10 has a front side and an opposed rear side 10*b* as well as opposed lateral sides.

In this example, drill pipe racks, here embodied as carrousel type racks 14, are located adjacent the lateral sides of the mast 10, as is known in the art.

At the rear moonpool area, the vessel is provided with a working deck 15 arranged above the rear moonpool area 5*b*. As is preferred the working deck 15 is a mobile working deck, here liftable along the mast 10 to such a height that a blow-out preventer can be brought and held underneath the working deck 15 in raised position thereof at an elevated position relative to the mast 10. In a lowered, operative position, the working deck 15 preferably, as here, is level with the adjacent main deck area.

In view of assembly and disassembly of a riser string along a firing line 20 through the rear moonpool area 5*b* the vessel is equipped with a riser string assembly hanger 17 that is adapted to suspended therefrom a riser string in the firing line 20 into the sea during the riser assembly and disassembly process. As preferred, this hanger 17 is mounted on the working deck 15, e.g. embodied as a riser spider, e.g. provided with a gimballing support so as to allow for angular variation between the riser string and the working deck, e.g. due to sea motion of the vessel.

The vessel 1 has a riser string handling capacity hoisting device including a riser string lifting tool 25 which is movable up and down relative to the mast 10 and that is adapted to connect to an end of a riser section, preferably of a pre-assembled riser stand as will be explained below, and is embodied to support the weight of a riser string in the firing line 20 when released from the riser string assembly hanger 17.

The riser string lifting tool 25 here is suspended from a travelling hanger device 26 that is movable up and down along the rear side of the mast 10 along one or more vertical rails 27.

The hanger device 26 is suspended by one or more cables 28 from a sheave arrangement 29 at the top of the mast, which one or more cables 28 are connected to one or more winches 29*a*, e.g. arranged within the mast 10.

It is noted that the firing line 20 is outside of the rear side 10*b* of the mast 10 so that the firing line 20 can be reached without hindrance in the process of upending a riser section or riser stand from the rear of the vessel.

In an alternative embodiment, the mast 10 is replaced by a derrick type tower having a latticed frame with corner posts that forms a frame extending over the moonpool. It is then envisaged that the riser storage is outside of the derrick type tower and the derrick is provided with a V-door or similar to allow passage of a riser section or riser stand into and out of the derrick.

The vessel also has a second hoisting device having a load attachment device 30 which is movable up and down relative to the mast at a side opposed from the riser firing line 20, so as to allow for handling of items passing through the other moonpool area along a second firing line 21 distinct and spaced from the first firing line 20 where the riser string assembly takes place.

The second firing line 21 extends through the front moonpool area 5*a*. Along this firing line 21 primarily drilling operations are performed.

The second hoisting device is embodied as a drilling drawworks, and is provided with a topdrive 31 suspended from the load attachment device 30 to perform drilling operations. The load attachment device 30 is preferably embodied similar as the travelling hanger device 26.

A working deck 32 is arranged above the moonpool area 5*a* and may include a rotary table, iron roughneck machine, etc.

The vessel 1 is thus capable of assembly of a riser string in firing line 20. For transfer of the riser string to the other firing line 21 a riser string support cart 35 is provided that is displaceable within the moonpool, e.g. skiddable over rails along the lateral sides of the moonpool 5.

The vessel has a riser storage hold 40, here as is preferred, within the hull 2 aft of the moonpool 5.

The riser storage hold 40 comprises storage racks adapted to store therein parallel stacks of multiple riser sections and/or pre-assembled riser stands in horizontal orientation.

The riser storage hold is provided with first length storage racks 80 adapted to store therein single first length riser sections 85 and/or pre-assembled riser stands each having a length of at least 100 ft. (30.48 m), e.g. of 120 ft. (36.57 m) or 150 ft. (45.72 m). In the example depicted in the figures the first length is 150 ft.

The riser storage hold is provided with second length storage racks 90 adapted to store therein single second length riser sections 95 each having a length of between 50 ft. (15.24 meters) and 90 ft. (27.43 meters), e.g. of 75 ft. (22.86 meters). In the example depicted in the figures the second length is 75 ft.

The second length storage racks 90 are arranged in sets of two arranged, with the two racks 90 being in line with one another and parallel to the adjacent longer first length storage racks 80.

A first group of first length storage racks 80 is arranged adjacent one side of the transfer station 50 and a second group of first length storage racks 80 is arranged adjacent another side of the transfer station 50.

A first group of second length storage racks 90 is arranged along the first group of first length storage racks and a second group of second length storage racks 90 is arranged along said second group of first length storage racks.

Each storage rack 80, 90 comprises at ends thereof a pair of adjacent riser end support columns that form a vertical slot which is adapted to receive therein an end portion, e.g. a flange, of a riser section 85, 95.

The riser storage hold has a floor 40*a*, port and starboard side walls 40*b,c*, and a roof 41.

An elongated riser transfer opening 45 is present between the deck 9 and the roof 41.

The riser transfer opening 45 extends in a direction parallel to the storage racks and has a length, here of at least 150 ft., and a width so as to allow for transfer of a single riser section or a single riser stand in horizontal orientation via the riser transfer opening out of and into the riser storage hold.

Within the storage 40 a riser transfer station 50 is arranged below the riser transfer opening 45. The station is provided with a transfer elevator that is adapted to raise and lower a single riser section or a single riser stand in horizontal orientation thereof so as to pass the riser section or a riser stand through the riser transfer opening 45.

In the storage hold 40 a first overhead travelling beam crane 60 is arranged.

The crane 60 is capable of lifting and lowering a single riser section 85,95, either of first length or of second length as described herein, as well as a single pre-assembled first length riser stand as described herein, at least allowing for removal of a single riser section or a single riser stand riser stand from a storage rack and for placing a single riser section 85, 95 or a single riser stand into a storage rack respectively. The crane 60 is also capable of transverse transportation of a single riser section 85, 95 or a single riser stand at least between the transfer station 50 and a position above each of the storage racks 80, 90 in the storage 40.

The first crane 60 comprises:

- a travelling beam 61 extending in a direction parallel to the storage racks and supported at each end thereof on a crane rail 62, 63 perpendicular to the storage racks, here transverse to the hull 2,
- a winch trolley 65 provided with one or more winches 66, 67 and displaceable along the travelling beam 61,
- an elongated gripper frame 68 suspended by one or more winch driven cables 69*a*, 69*b* from the winch trolley, 65. The gripper frame 68 is provided with multiple riser grippers 70*a, b* that are each adapted to engage on a single riser section 85, 95 or a single riser stand at spaced gripping locations thereof.

The gripper frame 68 is provided with two riser grippers 70*a, b* that are adapted and arranged to engage on the end portions of second length riser section 95, here on end portions of a 75 ft. riser section.

The first length riser sections 85 are provided at intermediate locations along the length thereof with two riser gripper engageable portions, here hooks 140, having a spacing the same as the spacing between end portions of a second length riser section 95 so as to allow said two riser grippers 70*a, b* to engage on said gripper engageable portions 140 of the first length riser section 85.

The gripper frame 68 is provided, at each end thereof, with a telescoping extender 68*a, b* having an extender end. Each extender 68*a, b* is extensible so that the extender end is adjacent the end of a first length riser section 85 or riser stand. The end is dimensioned to be slidable received between two columns of a storage rack in order to guide the gripper frame and riser during vertical travel.

The crane 60 is adapted to transfer a second length riser section 95 between each of the second length storage racks 80 and the transfer station 50, and to transfer a first length riser section 85 or riser stand between each of the first length storage racks 90 and the transfer station 50.

The transfer elevator comprises a first elevator unit 55 and a second elevator unit 55, as is preferred of the same design. These units 55 are spaced apart in direction parallel to the storage racks.

Figure 8:
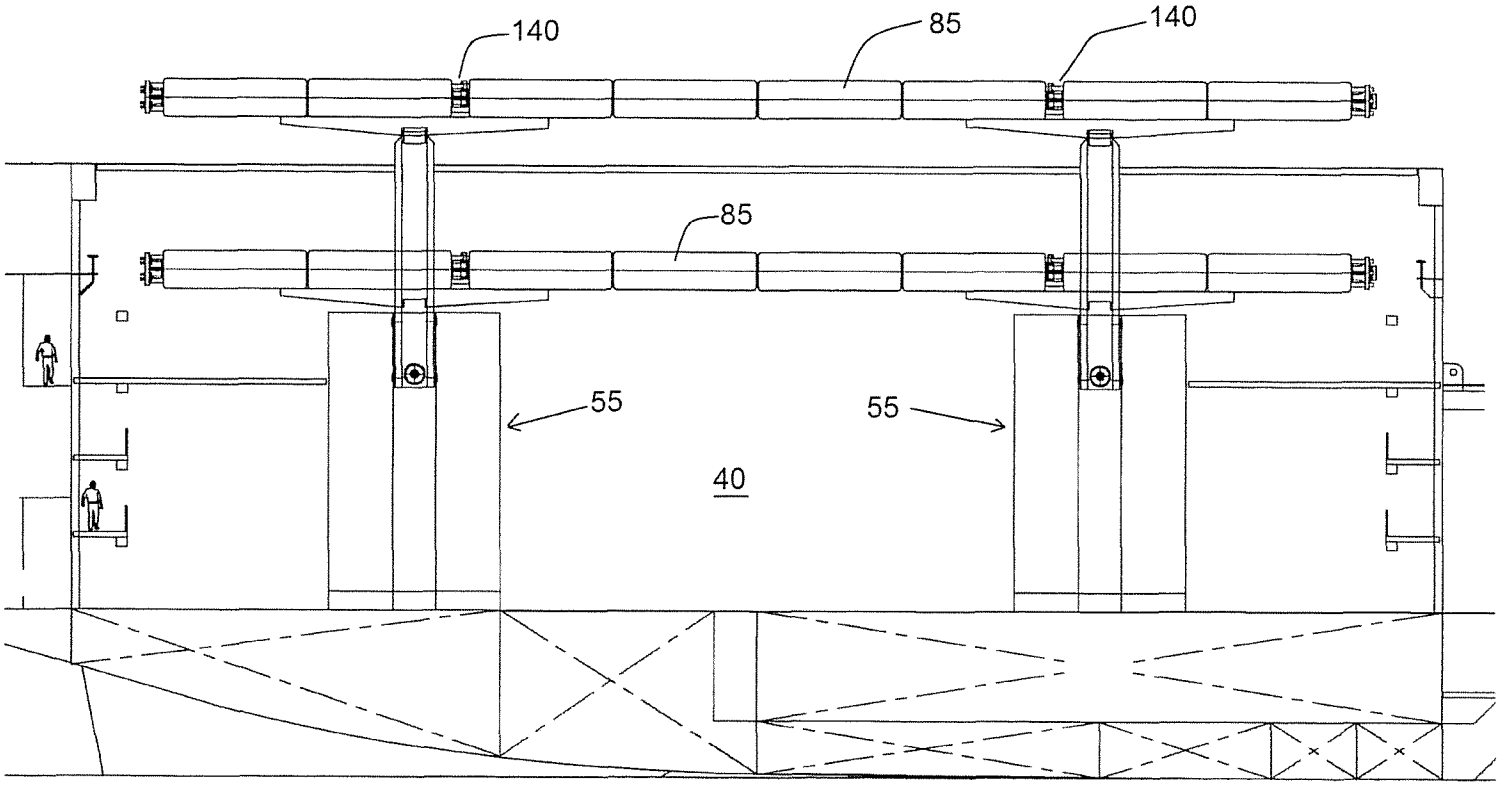
FIG. 8 illustrates the use of two transfer elevator units in unison for handling a first length riser section.
Figure 9:
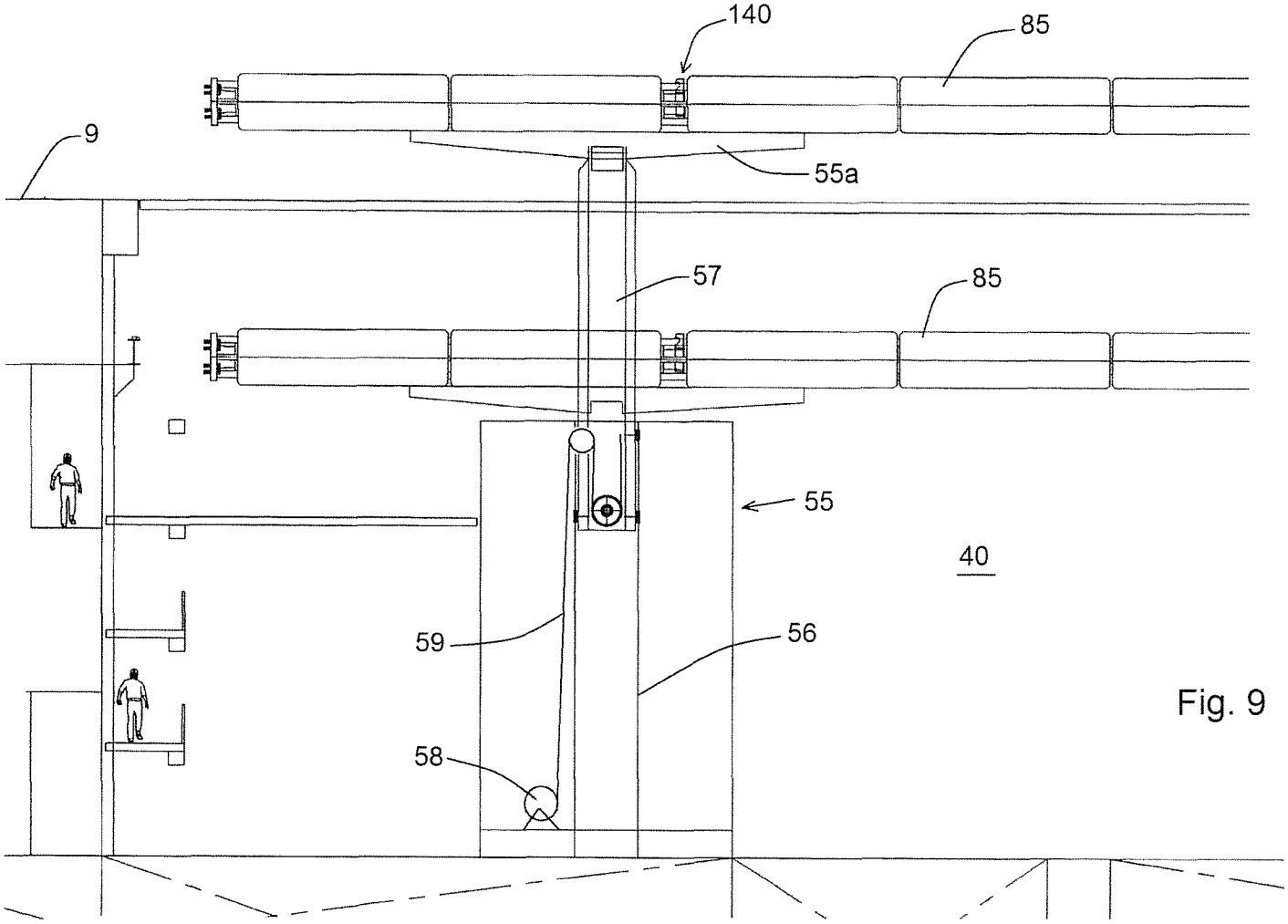
FIG. 9 shows a portion of FIG. 8 on a larger scale.
Figure 10:
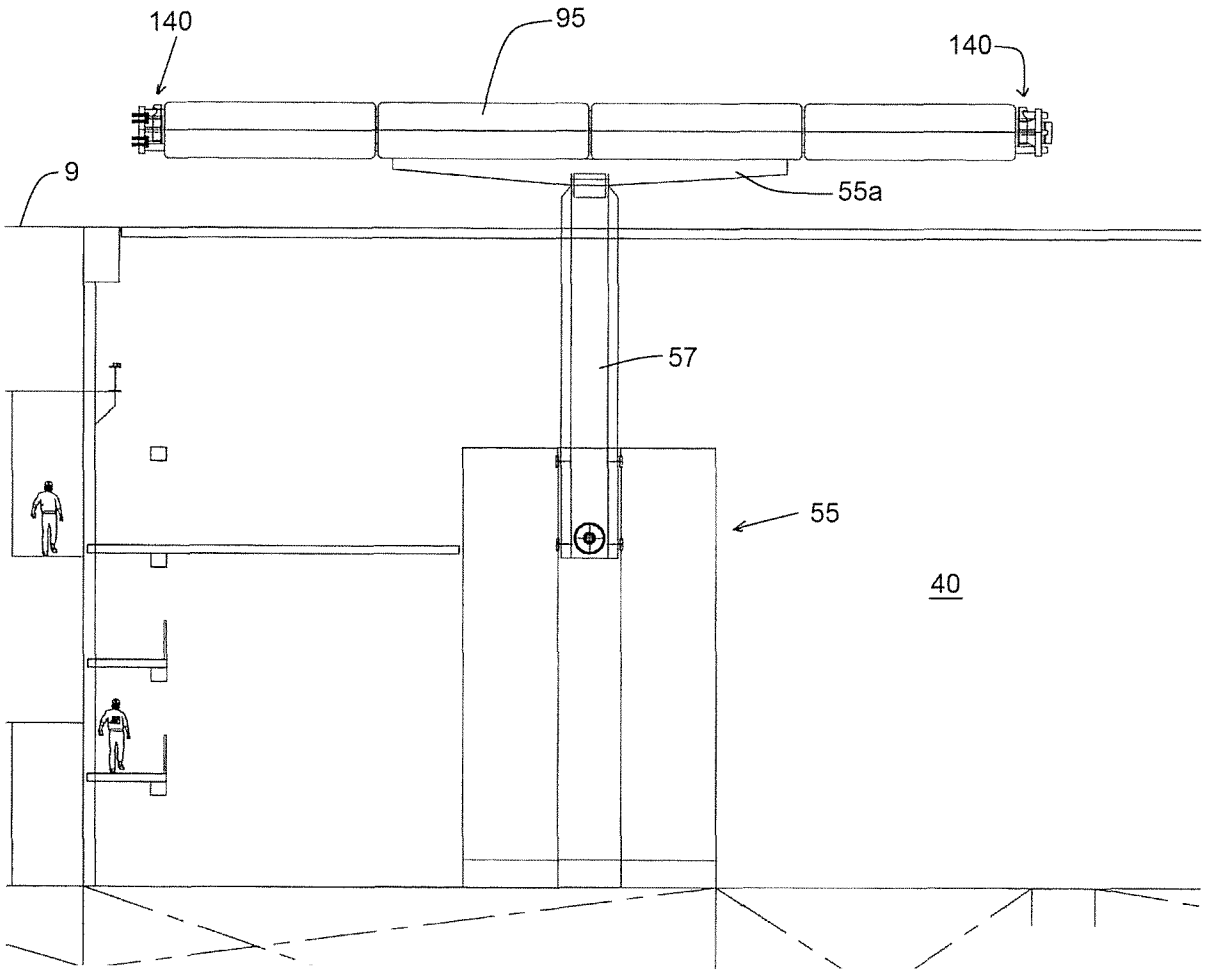
FIG. 10 illustrates the use of a single transfer elevator unit in stand-alone mode for handling a second length riser section.
Figure 11:
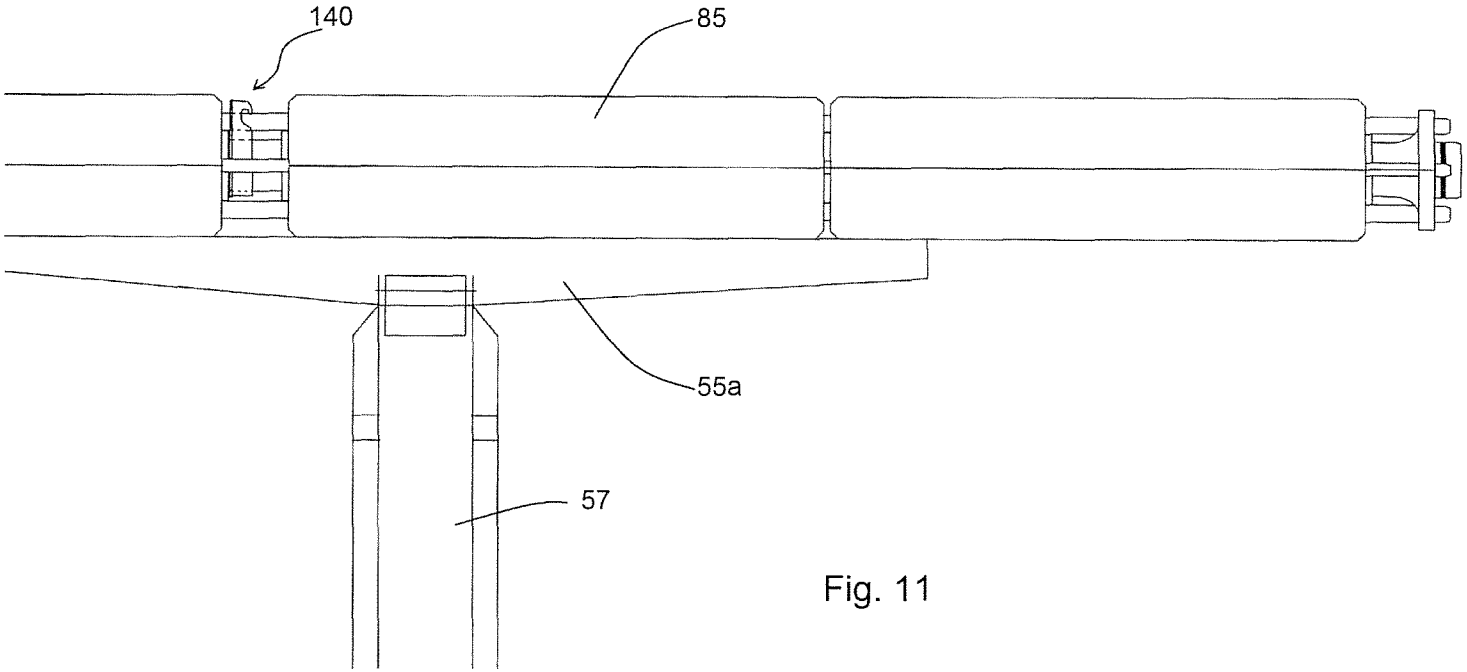
FIG. 11 illustrates the provision of a hook as gripper engageable portion on a first length riser section.
Figure 12:
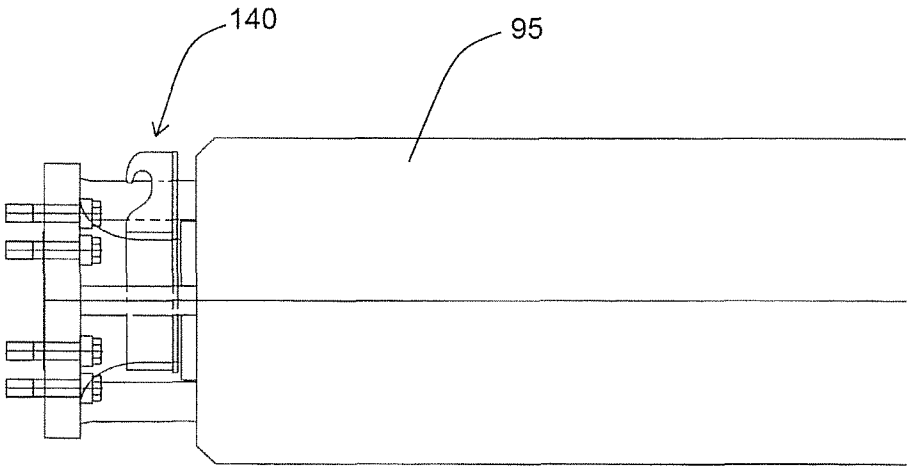
FIG. 12 illustrates the provision of a hook as gripper engageable portion at the end of a second length riser section.
Figures 13, 14, 15A, 15B, 16A, 16B:
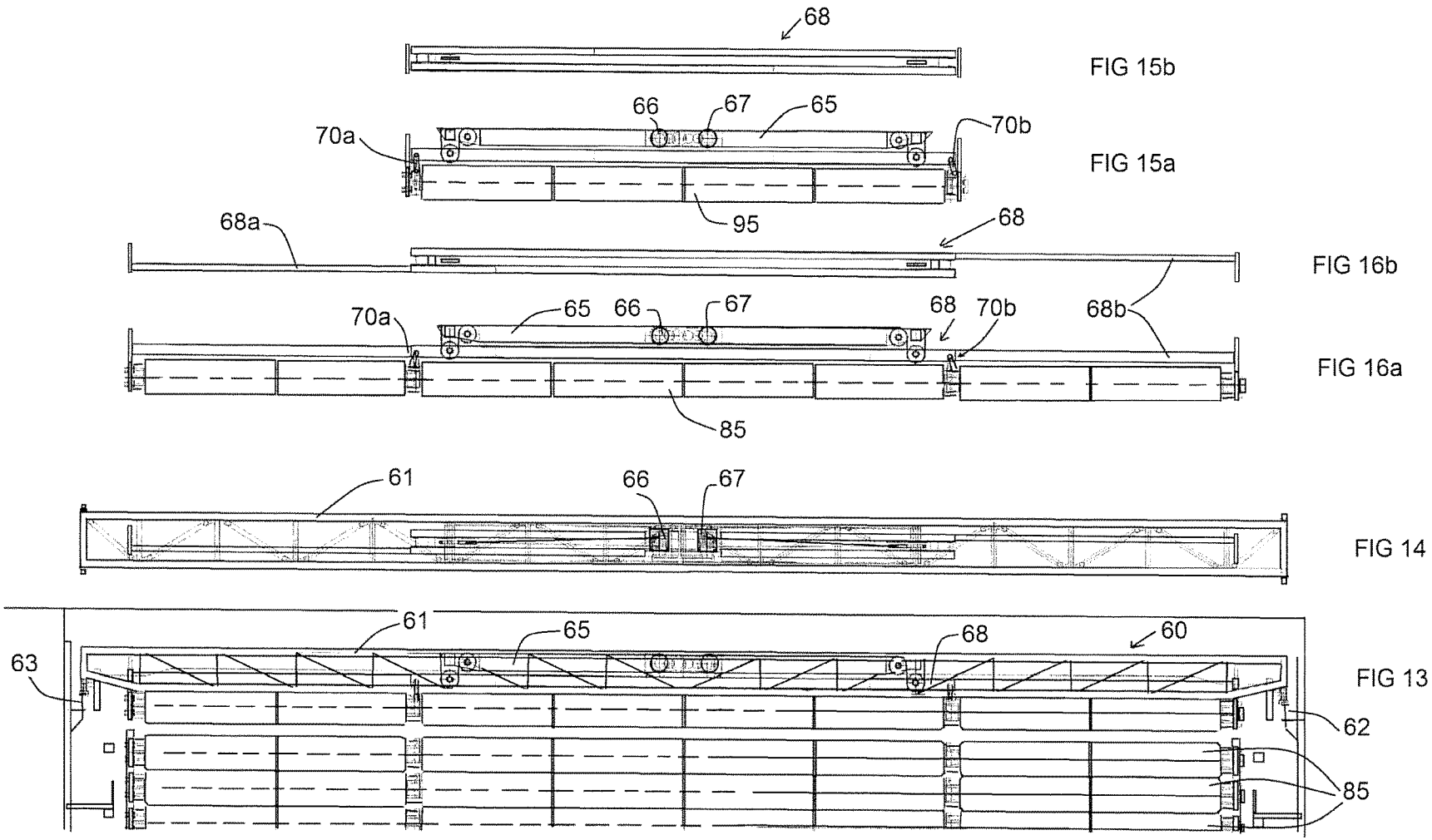
FIG. 13 illustrates an overhead crane handling a first length riser section in the storage hold of the vessel of FIG. 1.
FIG. 14 shows the overhead crane of FIG. 13 from above.
FIG. 15*a* shows the winch trolley and gripper frame of the crane of FIG. 13 when handling a second length riser section.
FIG. 15*b* shows the gripper frame of FIG. 15*a* from above.
FIG. 16*a* shows the winch trolley and gripper frame of the crane of FIG. 13 when handling a first length riser section with the extenders in extended position.
FIG. 16*b* shows the gripper frame of FIG. 16*a* from above.
Figure 17:
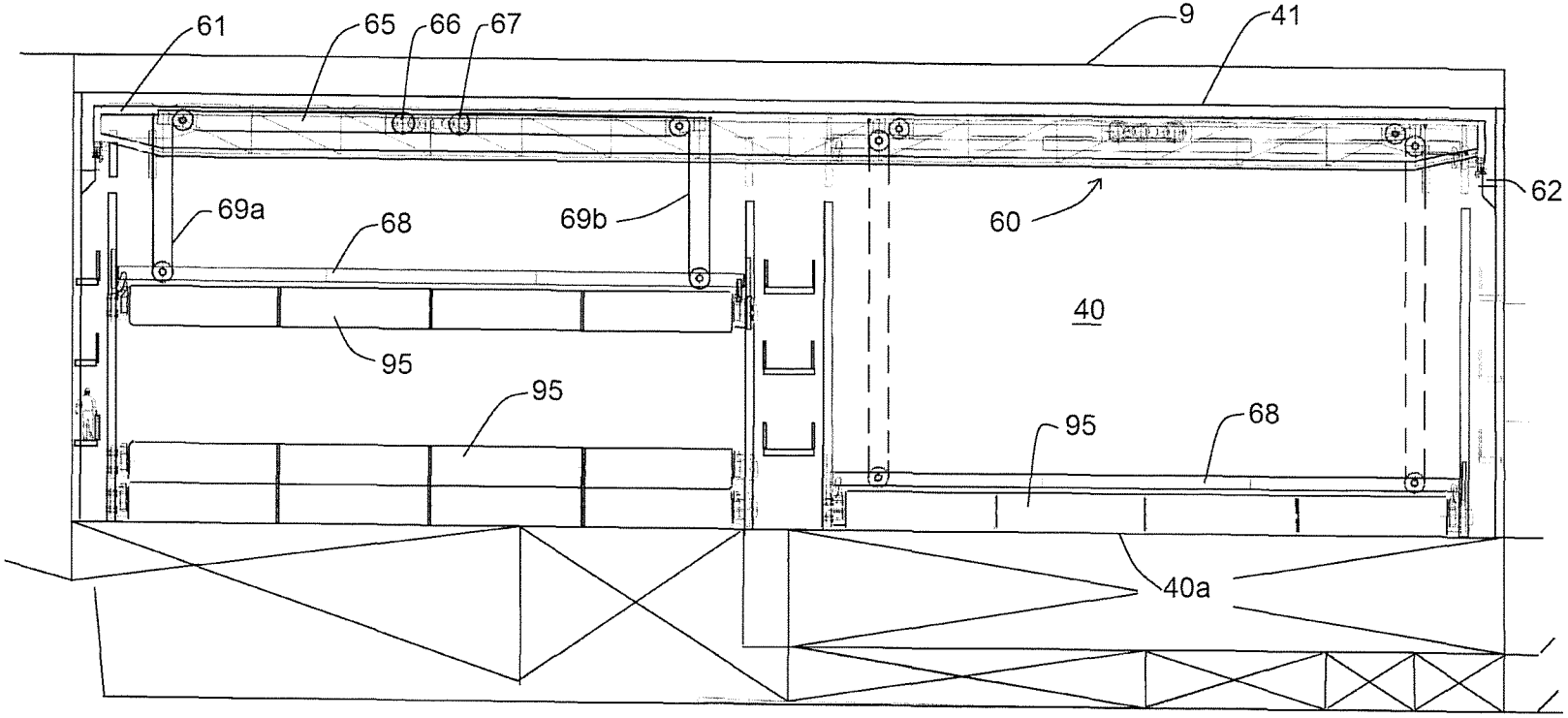
FIG. 17 illustrates the handling of second length riser sections in the storage hold by means of the crane of FIG. 13.

Each of the elevator units 55 is adapted to selectively operate stand-alone or in unison. In stand-alone mode each elevator unit 55 is adapted to raise and lower a second length riser section (FIG. 10). When operating in unison the elevator units 55 raise and lower a first length riser section or single riser stand together (FIGS. 8,9).

Each elevator unit 55 comprises a vertical guide structure 56, stationary mounted in the storage hold 40. Further a telescoping member 57 is provided, which is guided by the vertical guide structure 56. The elevator unit further comprises a winch 58 and winch driven cable 59 connected to the telescoping member 57 to cause vertical motion thereof. A riser support member 55*a* is mounted on the telescoping member 57 and is adapted to support a riser section 85, 95 or riser stand.

The riser support member is a riser support table 55*a* having a length of between 20 and 50 ft.

Figure 7A:
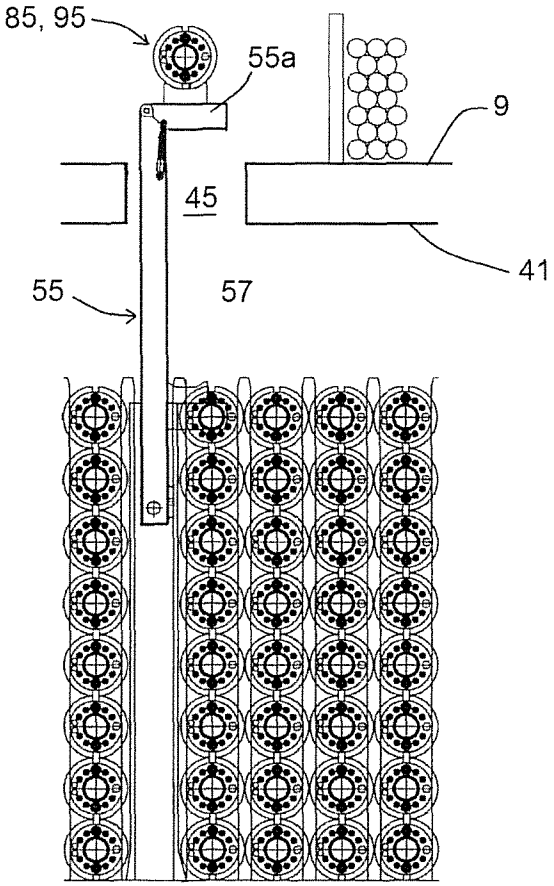
FIG. 7*a* illustrates a transfer elevator unit holding a riser section in raised condition.
Figure 7B:
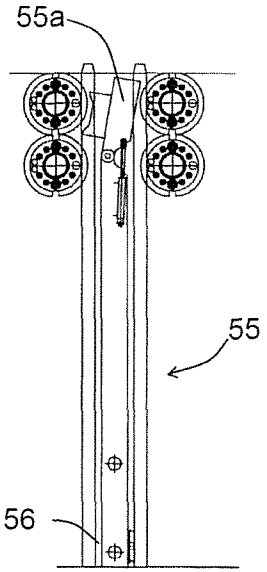
FIG. 7*b* illustrates the transfer elevator unit in inoperative condition.

The riser support member 55*a* is pivotally connected to the telescoping member 57 and is tiltable, her by hydraulic cylinder, between a horizontal operation position wherein a riser section or riser stand can rest on said riser support member and a vertical inoperative storage position (see FIGS. 7*a*, 7*b*).

The riser storage hold 40 is provided with a first elongated riser workshop 110 and a second elongated riser workshop 120, each having a length at least sufficient to receive therein a first length riser section or stand. Each riser workshop has a floor, and, as is preferred also walls and a roof.

Each riser workshop 110, 120 is arranged parallel to the storage racks and the workshop is adapted to accommodate at least one riser section 85, 95 or riser stand in horizontal orientation. The workshop provides an enclosure for personnel performing work on the riser section, e.g. maintenance and/or inspection of the riser section and/or interconnecting sections to form a pre-assembled stand.

The overhead travelling beam crane 60 is adapted to place a riser section 85, 95 in each of the workshops 110, 120 and remove a riser section from the workshop. In this example it is envisaged that the workshops 110, 120 have a roof with a riser transfer opening therein, preferably said opening being provided with a mobile roof cover, e.g. one or more hatches or a tarpaulin.

As can be seen the workshops 110, 120 are arranged along the port and starboard sides of the hold 40, along opposite sides of the storage racks 80, 90. The transfer station 50 is arranged centrally between storage racks 80, 90.

The riser storage hold is provided with a second overhead travelling beam crane 60' which is provided to obtain a redundant crane system for handling riser sections 85, 95. The crane 60' is preferably of the same design as the crane 60. The travelling beam of crane 60' preferably travels on the same crane rails 62, 63 as the first overhead travelling beam crane 60.

The second travelling beam crane 60' here has a parking position above one of the workshops, here at 120, which workshop 120 preferably is located along a side of the riser storage hold.

Figure 4:
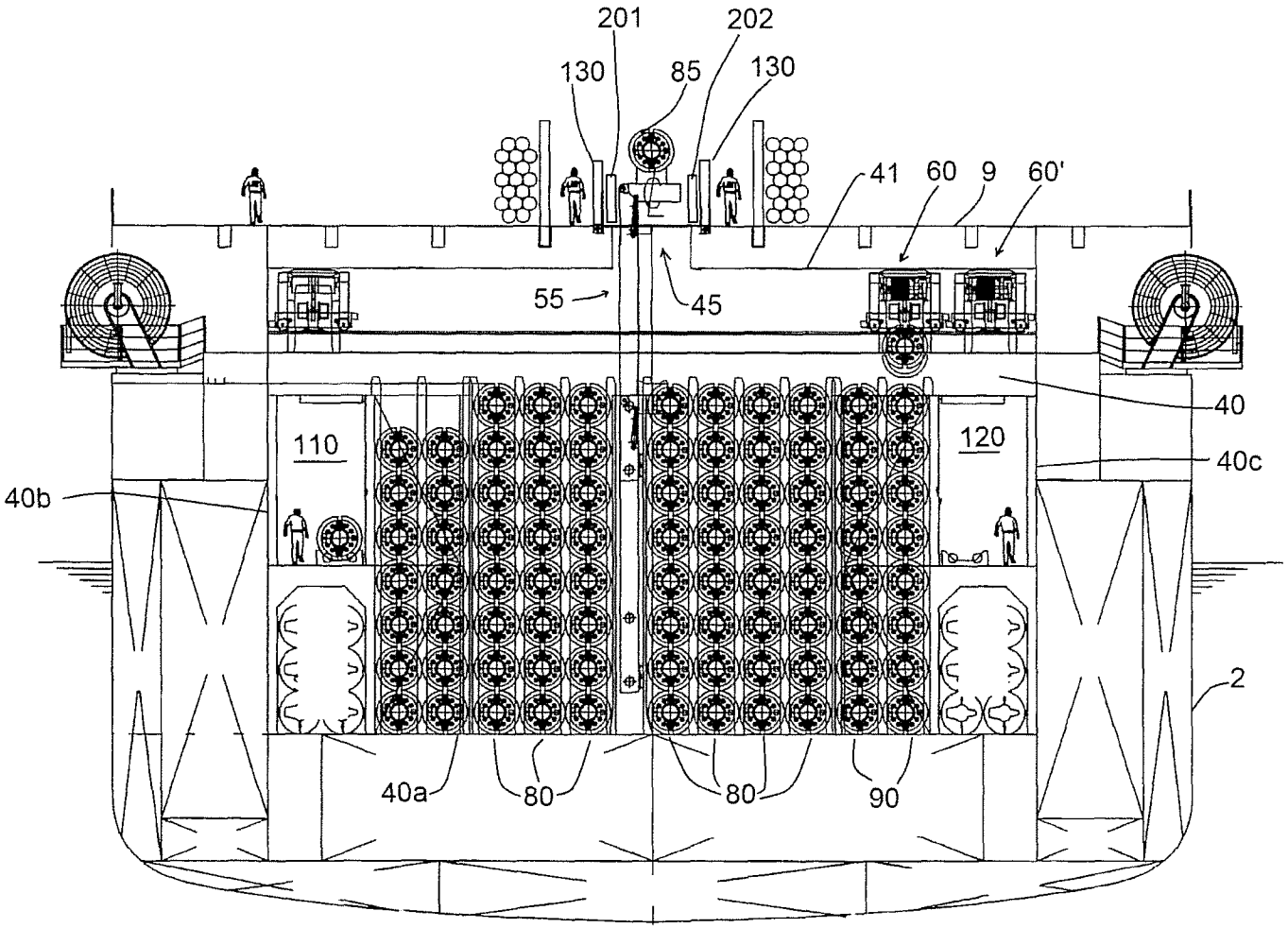
FIG. 4 shows a transverse section of the vessel of FIG. 1 showing the riser storage hold, the riser transfer elevator, the overhead cranes.
Figure 5:
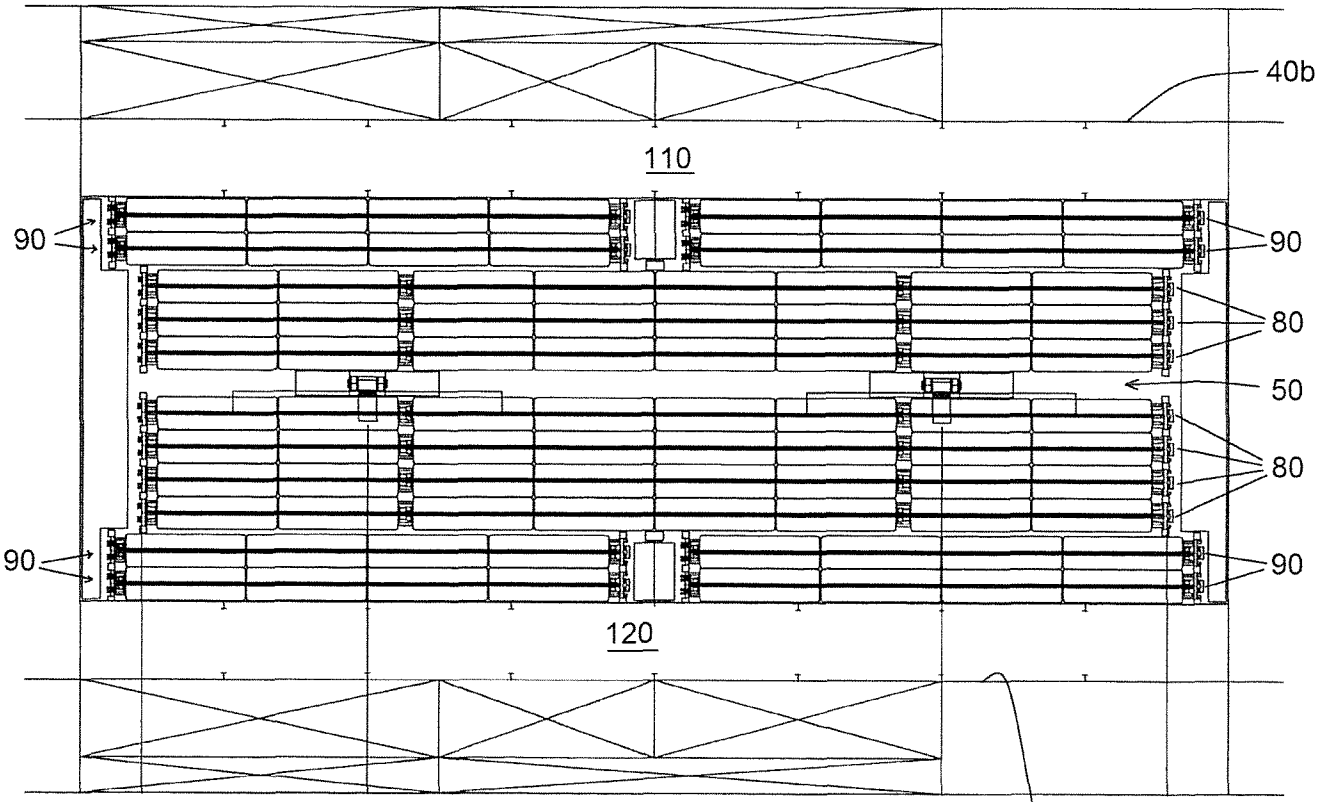
FIG. 5 shows a horizontal section of the riser storage hold of the vessel of FIG. 1.
Figure 6:
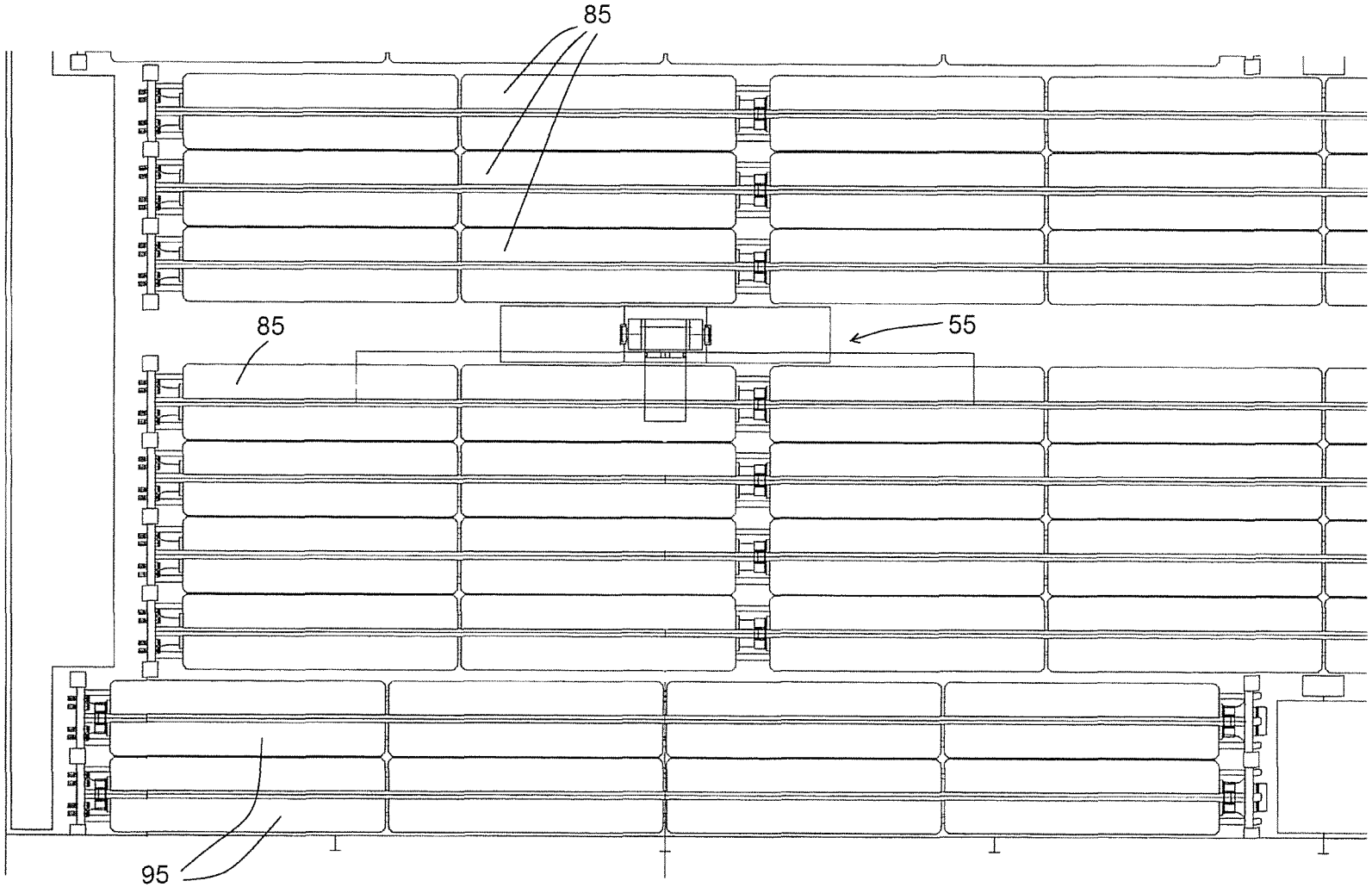
FIG. 6 shows on a larger scale a portion of FIG. 5.

FIG. 4 shows that a further parking position is available for the crane 60 above the other workshop 110, e.g. allowing to park crane 60 there when servicing is required and crane 60' then has full access to all riser sections stored in the storage racks.

The vessel is provided with movable hatches which in a closed position thereof close the transfer opening 45 and in an opened position thereof open the transfer opening. e.g. pivotal hatches 130*a*, 130*b*.

Substantially horizontal rails 150 extend along opposite longitudinal sides of the riser transfer opening 45.

The vessel comprises a riser horizontal transport device 200 that is mounted on horizontal rails 150 and is adapted to receive and hold a riser section 85, 95 or riser stand that has been raised through said transfer opening 45 by the riser elevator unit or units 55 and to horizontally transport the riser section 85, 95 or riser stand so that a leading end thereof is connectable to a riser string lifting tool that is adapted to support the weight of a riser string in the firing line 20 of the vessel.

The riser horizontal transport device comprises a catwalk machine having a mobile catwalk machine frame that is movable over the horizontal rails 150. The catwalk machine frame has a rear end and a front end and is movable over the horizontal rails 150 at least in a loading position generally above the opening 45 and in a riser upending position closer to the firing line 20.

The catwalk machine frame has two parallel and horizontal frame beams 201, 202. At the rear end the beams 201, 202 are rigidly and permanently interconnected by a transverse beam 203. The beams 201, 202 are less long than the transfer opening 45 and the first length riser section or stand that is stored in the hold 40. In order to obtain a sturdy frame during transportation of the riser section it is envisaged that, here only at the front end, the frame beams 201, 202 are interconnected by a mobile transverse connector 204 that is movable between an inactive position allowing for vertical passage of the single riser section or single riser stand and an active position wherein the transverse connector 204 interconnects the frame beams 201, 202. When lifting and lowering a section of first length the connector 204 is inactive or opened. A shorter second length may be handled with the connector remaining closed as the opening in the frame of the machine is then large enough.

A skate 205 is supported by the frame beams 201, 202 and travels over the frame beams. As is known in the art the skate 205 comprises a riser end support to support thereon a rearward end of a riser section 85, 95 or riser stand.

As will be appreciated the horizontal frame beams 201, 202 of the catwalk machine frame define between them an opening having a width so as to allow for the vertical passing of a single riser section 85, 95 (equipped with buoyancy members) or a single riser stand in horizontal orientation through said opening, preferably by means of the transfer elevator unit or units 55.

The catwalk machine, in addition to the skate 205, comprises one or more additional riser support members 206 that are movable between an inactive position allowing for said vertical passage of the single riser section 85, 95 or single riser stand and an active position wherein the riser section or riser stand is supported on said riser support member 206.

If desired the catwalk machine 200 is provided with a tailing-in arm device, e.g. with one tailing arm fitted to the front end of each beam 201, 202.

Figure 18:
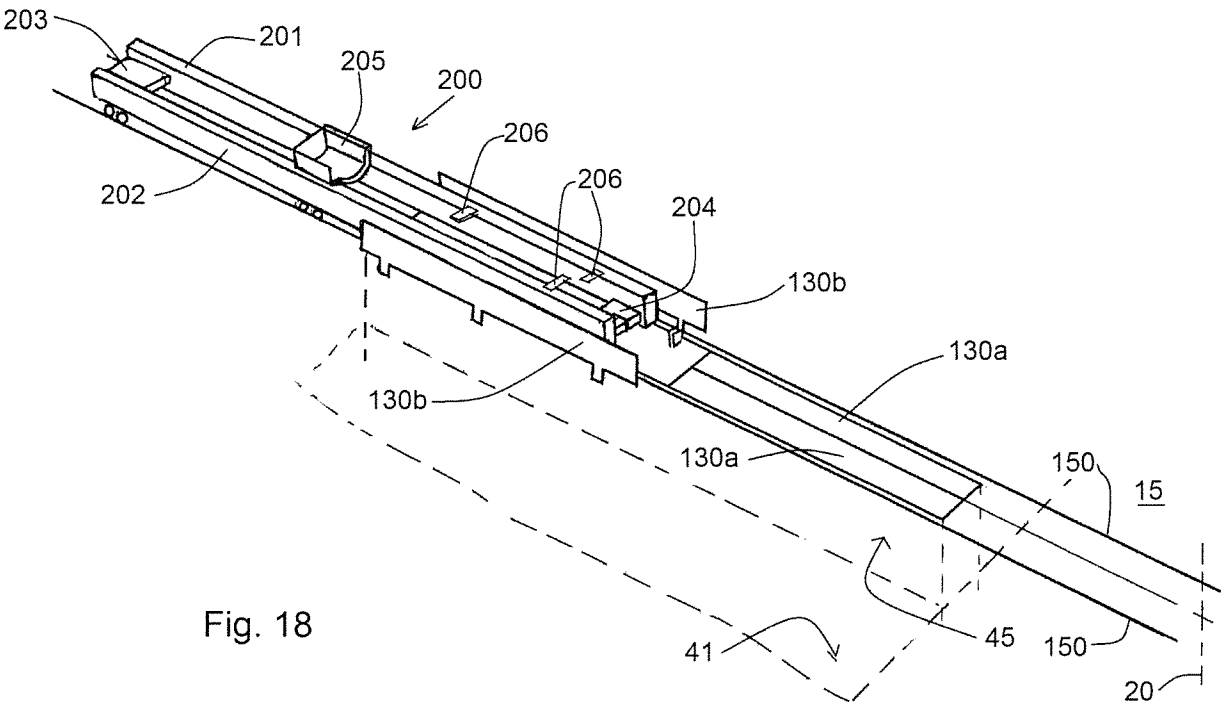
FIG. 18 illustrates the catwalk machine, transfer opening and associated hatches of the vessel of FIG. 1.

As can be seen in FIG. 18 a first set of pivotal hatches 130*a,b* is arranged along one longitudinal side of the transfer opening 45 and a second set of pivotal hatches 130*a, b* is arranged along the opposed longitudinal side of the transfer opening 45, so that with said hatches 130*a, b* in horizontal position the transfer opening 45 is closed and with said hatches in upward pivoted position the transfer opening 45 is open.

As can be seen—in upward pivoted position—these hatches 130*a, b* are to the outside of the horizontal rails 150 at a spacing allowing for the travel of the catwalk machine 200 over said horizontal rails 150 between said upward pivoted hatches.

The invention claimed is:

1. A vessel adapted to perform subsea wellbore related operations involving a riser string between the subsea wellbore and the vessel, said vessel comprising:

a hull having a deck;

a riser storage hold present within said hull below said deck, said riser storage hold comprising storage racks adapted to store therein parallel stacks of multiple riser sections and/or pre-assembled riser stands in a horizontal orientation, and said riser storage hold having a floor, side walls, and a roof;

an elongated riser transfer opening between said deck and said roof, said riser transfer opening extending in a direction parallel to said storage racks, said riser transfer opening having a length and a width so as to allow for transfer of a single riser section or a single riser stand in said horizontal orientation thereof via said riser transfer opening out of and into the riser storage hold;

a riser transfer station arranged within said riser storage hold below said riser transfer opening, wherein a transfer elevator is provided within said riser storage hold, the transfer elevator being adapted to raise and lower a single riser section or a single riser stand in said horizontal orientation thereof so as to pass the riser section or the riser stand through the riser transfer opening; and a first overhead travelling beam crane arranged within the riser storage hold, said first overhead travelling beam crane being adapted to lift and lower a single riser section or a single riser stand at least allowing for removal of a single riser section or a single riser stand riser stand from a storage rack and for placing a single riser section or a single riser stand into a storage rack respectively, and said first crane being adapted for transverse transportation of a single riser section or a single riser stand at least between said transfer station and a position above a storage rack, wherein said first overhead travelling beam crane comprises:

a travelling beam extending in a direction parallel to said storage racks and supported at each end thereof on a crane rail extending perpendicular to said storage racks;

a winch trolley provided with one or more winches and displaceable along said travelling beam; and an elongated gripper frame suspended by one or more winch driven cables from said winch trolley, said gripper frame being provided with multiple riser grippers adapted to engage on a single riser section or a single riser stand at spaced gripping locations thereof, wherein the riser storage hold is provided with first length storage racks adapted to store therein single first length riser sections and/or pre-assembled riser stands each having a length of at least 100 ft. (30.48 m), wherein the riser storage hold is provided with second length storage racks adapted to store therein single second length riser sections each having a length of between 50 ft. (15.24 meters) and 90 ft. (27.43 meters), and wherein the first overhead travelling beam crane is adapted to transfer a second length riser section between each of said second length storage racks and the transfer station, and to transfer a first length riser section or riser stand between each of said first length storage racks and the transfer station.

2. The vessel according to claim 1, wherein a first group of first length storage racks is arranged adjacent one side of the transfer station and a second group of first length storage racks is arranged adjacent another side of the transfer station, and wherein a first group of second length storage racks is arranged along said first group of first length storage racks and wherein a second group of second length storage racks is arranged along said second group of first length storage racks.

3. The vessel according to claim 1, wherein the riser storage hold is provided with at least one elongated riser workshop having a floor and walls and a roof, said riser workshop being arranged parallel to the storage racks and the workshop being adapted to accommodate at least one riser section or riser stand in horizontal orientation, the workshop providing an enclosure for personnel performing work on the riser section or riser stand, and wherein the first overhead travelling beam crane is adapted to place the riser section or riser stand in the workshop and remove the riser section or riser stand from the workshop.

4. The vessel according to claim 3, wherein a first elongated riser workshop and a second elongated riser workshop are arranged in the riser storage hold, along opposite sides of the storage racks, with the transfer station centrally between storage racks.

5. The vessel according to claim 1, wherein the riser storage hold is provided with a second overhead travelling beam crane arranged within the riser storage hold, said second overhead travelling beam crane being adapted to lift and lower a single riser section or a single riser stand at least allowing for removal of a single riser section or a single riser stand riser stand from a storage rack and for placing a single riser section or a single riser stand into a storage rack respectively, and said second overhead travelling beam crane being adapted for transverse transportation of a single riser section or a single riser stand at least between said transfer elevator and a position above a storage rack, wherein said second overhead travelling beam crane comprises:

a second travelling beam extending in a direction parallel to said storage racks and supported at each end thereof on the same crane rail as the first overhead travelling beam crane;

a second winch trolley provided with one or more winches and displaceable along said travelling beam; and an elongated gripper frame suspended by one or more winch driven cables from said winch trolley, said gripper frame being provided with multiple riser grippers adapted to engage on a single riser section or a single riser stand at spaced gripping locations thereof.

6. The vessel according to claim 5, wherein a first elongated riser workshop and a second elongated riser workshop are arranged in the riser storage hold, at least one of said first and second riser workshops being arranged along a side of the riser storage hold, and wherein the second travelling beam crane has a parking position above said workshop along the side of the riser storage hold.

7. The vessel according to claim 1, wherein the gripper frame is provided with two riser grippers that are adapted and arranged to engage on the end portions of a second length riser section.

8. The vessel according to claim 1, wherein the gripper frame is provided, at each end thereof, with a telescoping extender having an extender end, the telescopic extender being extensible so that the extender end is adjacent an end of a first length riser section or riser stand, wherein each first length storage rack comprises at ends thereof a pair of adjacent riser end support columns that form a vertical slot which is adapted to receive therein an end portion of a riser section or riser stand, and wherein the extender end is adapted to be slidingly received between said riser end support columns.

9. The vessel according to claim 1, wherein substantially horizontal rails extend along opposite longitudinal sides of the riser transfer opening, and wherein the vessel comprises a riser horizontal transport device that is mounted on said horizontal rails and is adapted to receive and hold a riser section or riser stand that has been raised through said transfer opening by the riser elevator and to horizontally transport the riser section or riser stand so that a leading end thereof is connectable to a riser string lifting tool that is adapted to support the weight of a riser string in a firing line of the vessel.

10. The vessel according to claim 9, wherein the riser horizontal transport device comprises a catwalk machine having a mobile catwalk machine frame that is movable over said horizontal rails, wherein the catwalk machine frame has a rear end and a front end, and is movable over the horizontal rails at least in a loading position and in a riser upending position, wherein the catwalk machine frame has two parallel and horizontal frame beams, and wherein a skate is supported by said frame beams and travels over said frame beams, wherein the skate comprises a riser end support to support thereon a rearward end of a riser section or riser stand that are each supported on a respective horizontal rails, wherein the horizontal frame beams of the catwalk machine frame define between them an opening having a width so as to allow for the vertical passing of a single riser section or a single riser stand in said horizontal orientation thereof through said opening by means of the transfer elevator, and wherein the catwalk machine, in addition to the skate, comprises one or more additional riser support members that are movable between an inactive position allowing for said vertical passage of the single riser section or single riser stand and an active position wherein the riser section or riser stand is supported on said riser support member.

11. The vessel according to claim 10, wherein the frame beams are rigidly interconnected by a transverse beam near the rear end of the catwalk machine frame, and wherein the frame beams are interconnected by one or more mobile transverse connectors that are each movable between an inactive position allowing for said vertical passage of the single riser section or single riser stand and an active position wherein the transverse connector interconnects the frame beams.

12. The vessel according to claim 10, wherein the vessel is provided with one or more movable hatches which in a closed position thereof close the transfer opening and in an opened position thereof open the transfer opening, wherein a first set of pivotal hatches is arranged along one longitudinal side of the transfer opening and a second set of pivotal hatches is arranged along an opposed longitudinal side of the transfer opening, so that with said first and second set of pivotal hatches in horizontal position the transfer opening is closed and with said first and second set of pivotal hatches in an upward pivoted position the transfer opening is open, and wherein, in upward pivoted position, said first and second set of pivotal hatches are to the outside of the horizontal rails at a spacing allowing for the travel of the catwalk machine over said horizontal rails between said upward pivoted hatches.

13. A vessel adapted to perform subsea wellbore related operations involving a riser string between a subsea wellbore and the vessel, said vessel comprising:

a hull having a deck;

a riser storage hold present within said hull below said deck, said riser storage hold comprising storage racks adapted to store therein parallel stacks of multiple riser sections and/or pre-assembled riser stands in horizontal orientation, and said riser storage hold having a floor, side walls, and a roof; and a first overhead travelling beam crane arranged within the riser storage hold, said first crane being adapted to lift and lower a single riser section or a single riser stand at least allowing for removal of a single riser section or a single riser stand riser stand from a storage rack and for placing a single riser section or a single riser stand into a storage rack respectively, and said crane being adapted for transverse transportation of a single riser section or a single riser stand at least between said transfer elevator and a position above a storage rack, wherein said first overhead travelling beam crane comprises:

a travelling beam extending in a direction parallel to said storage racks and supported at each end thereof on a crane rail perpendicular to said storage racks;

a winch trolley provided with one or more winches and displaceable along said travelling beam; and an elongated gripper frame suspended by one or more winch driven cables from said winch trolley, said gripper frame being provided with multiple riser grippers adapted to engage on a single riser section or a single riser stand at spaced gripping locations thereof, wherein the riser storage hold is provided with a second overhead travelling beam crane arranged within the riser storage hold, said second overhead travelling beam crane being adapted to lift and lower a single riser section or a single riser stand at least allowing for removal of a single riser section or a single riser stand riser stand from a storage rack and for placing a single riser section or a single riser stand into a storage rack respectively, and said second overhead travelling beam crane being adapted for transverse transportation of a single riser section or a single riser stand at least between said transfer elevator and a position above a storage rack, and wherein said second overhead travelling beam crane comprises:

a second travelling beam extending in a direction parallel to said storage racks and supported at each end thereof on the same crane rail as the first overhead travelling beam crane;

a second winch trolley provided with one or more winches and displaceable along said travelling beam; and an elongated gripper frame suspended by one or more winch driven cables from said winch trolley, said gripper frame being provided with multiple riser grippers adapted to engage on a single riser section or a single riser stand at spaced gripping locations thereof.

14. A vessel adapted to perform subsea wellbore related operations involving a riser string between a subsea wellbore and the vessel, said vessel comprising:

a hull having a deck;

a riser storage hold present within said hull below said deck, said riser storage hold comprising storage racks adapted to store therein parallel stacks of multiple riser sections and/or pre-assembled riser stands in horizontal orientation, and said riser storage hold having a floor, side walls, and a roof;

an elongated riser transfer opening between said deck and said roof, said elongated riser transfer opening extending in a direction parallel to said storage racks, and said elongated riser transfer opening having a length and a width so as to allow for transfer of a single riser section or a single riser stand in a horizontal orientation via said riser transfer opening out of and into the riser storage hold;

a riser transfer station arranged within said riser storage hold and provided with a transfer elevator that is adapted to raise and lower the single riser section or the single riser stand in said horizontal orientation thereof so as to pass the single riser section or the single riser stand through the riser transfer opening; and a crane arranged within the riser storage hold, said crane being adapted to lift and lower a single riser section or a single riser stand at least allowing for removal of a single riser section or a single riser stand riser stand from a storage rack and for placing a single riser section or a single riser stand into a storage rack respectively, and said crane being adapted for transverse transportation of a single riser section or a single riser stand at least between said transfer elevator and a position above a storage rack, wherein the riser storage hold is adapted to store therein single first length riser section and/or pre-assembled riser stands each having a length of at least 100 ft. (30.48 m), wherein the riser storage hold is adapted to store therein single second length riser sections each having a length of between 50 ft. (15.24 meters) and 90 ft. (27.43 meters), and wherein the transfer elevator comprises a first elevator unit and a second elevator unit that are spaced apart in a direction parallel to said storage racks, wherein each of said first and second elevator units are adapted to selectively operate stand-alone or in unison, wherein, for operating stand-alone, each of the first and second elevator units is adapted to raise and lower a second length riser section, and wherein, for operating in unison, said first and second elevator units are further adapted to raise and lower a first length riser section or single riser stand.

15. A vessel adapted to perform subsea wellbore related operations involving a riser string between a subsea wellbore and the vessel, said vessel comprising:

a hull having a deck;

a riser storage hold present within said hull below said deck, said riser storage hold comprising storage racks adapted to store therein parallel stacks of multiple riser sections and/or pre-assembled riser stands in horizontal orientation, and said riser storage hold having a floor, side walls, and a roof;

an elongated riser transfer opening extending between said deck and said roof, said elongated riser transfer opening being a parallel to said storage racks, and said elongated riser transfer opening having a length and a width so as to allow for transfer of a single riser section or a single riser stand in horizontal orientation via said riser transfer opening out of and into the riser storage hold; and a riser transfer station arranged within said riser storage hold and provided with a transfer elevator that is adapted to raise and lower a single riser section or a single riser stand in horizontal orientation thereof so as to pass the single riser section or a single riser stand through the riser transfer opening, wherein a first elongated riser workshop and a second elongated riser workshop are arranged in the riser storage hold, each of the first and second workshops being arranged along a side of the storage hold, the storage racks being positioned between said first and second workshops, and wherein each of the first and second riser workshops is arranged parallel to the storage racks and each of the first and second workshops is adapted to accommodate at least one riser section or riser stand in horizontal orientation, each of the first and second workshops providing a space for personnel performing work on a riser section or a riser stand, and wherein the vessel comprises a crane is adapted to place a riser section or riser stand in each of the first and second workshops and remove a riser section or a riser stand from each of the first and second workshops.

16. A vessel adapted to perform subsea wellbore related operations involving a riser string between the subsea wellbore and the vessel, said vessel comprising:

a hull having a deck, a riser storage hold present within said hull below said deck, said riser storage hold comprises storage racks adapted to store therein parallel stacks of multiple riser sections and/or pre-assembled riser stands in a horizontal orientation, said riser storage hold has a floor, side walls, and a roof, an elongated riser transfer opening between said deck and said roof, said riser transfer opening extending in a direction parallel to said storage racks, said riser transfer opening having a length and a width so as to allow for transfer of a single riser section or a single riser stand in said horizontal orientation thereof via said riser transfer opening out of and into the riser storage hold, a riser transfer station arranged within said riser storage hold below said riser transfer opening and provided with a transfer elevator that is adapted to raise and lower a single riser section or a single riser stand in said horizontal orientation thereof so as to pass the riser section or the riser stand through the riser transfer opening, a first overhead travelling beam crane arranged within the riser storage hold, said first overhead travelling beam crane being adapted to lift and lower a single riser section or a single riser stand at least allowing for removal of a single riser section or a single riser stand riser stand from a storage rack and for placing a single riser section or a single riser stand into a storage rack respectively, and said first crane being adapted for transverse transportation of a single riser section or a single riser stand at least between said transfer station and a position above a storage rack, wherein said first overhead travelling beam crane comprises:

a travelling beam extending in a direction parallel to said storage racks and supported at each end thereof on a crane rail which extends perpendicular to said storage racks, a winch trolley provided with one or more winches and displaceable along said travelling beam, an elongated gripper frame suspended by one or more winch driven cables from said winch trolley, said gripper frame being provided with multiple riser grippers adapted to engage on a single riser section or a single riser stand at spaced gripping locations thereof, wherein the riser storage hold is provided with first length storage racks adapted to store therein single first length riser sections and/or pre-assembled riser stands each having a length of at least 100 ft. (30.48 m), and wherein the riser storage hold is provided with second length storage racks adapted to store therein single second length riser sections each having a length of between 50 ft. (15.24 meters) and 90 ft. (27.43 meters), wherein the first overhead travelling beam crane is adapted to transfer a second length riser section between each of said second length storage racks and the transfer station, and to transfer a first length riser section or riser stand between each of said first length storage racks and the transfer station, and wherein the transfer elevator comprises a first elevator unit and a second elevator unit that are spaced apart in direction parallel to said storage racks, wherein each of said first and second elevator units are adapted to selectively operate stand-alone or in unison, wherein, for operating stand-alone, each of the first and second elevator units is adapted to raise and lower a second length riser section, and wherein, for operating in unison, said first and second elevator units are further adapted to raise and lower a first length riser section or single riser stand.

17. The vessel according to 16, wherein each of the first and second elevator units comprises a vertical guide structure which is stationary mounted in said storage hold, and a telescoping member which is guided by said vertical guide structure, wherein each of the first and second elevator units further comprises a winch and a winch driven cable connected to said telescoping member to cause vertical motion thereof, and wherein a riser support member is mounted on said telescoping member and is adapted to support a riser section or riser stand.

* * * * *